United States Patent [19]

Gaubert

[11] 4,148,170

[45] Apr. 10, 1979

[54] PRODUCT WRAPPING MACHINE AND METHOD

[76] Inventor: Rene J. Gaubert, 4219 Oakmore Rd., Oakland, Calif. 94602

[21] Appl. No.: 837,284

[22] Filed: Sep. 27, 1977

Related U.S. Application Data

[63] Continuation-in-part of Ser. No. 654,597, Feb. 2, 1976, abandoned.

[51] Int. Cl.[2] ..... B65B 11/08

[52] U.S. Cl. ..... 53/466; 53/232; 53/379; 53/388; 53/463; 53/479; 53/579

[58] Field of Search ..... 53/33, 124 R, 124 CC, 53/178, 194, 19 J, 218, 230, 232, 233, 234, 374, 375, 387, 388, 379, 463, 466, 578, 579; 93/36.8, 49 R

[56] References Cited

U.S. PATENT DOCUMENTS

| | | | |
|---|---|---|---|
| 1,942,885 | 1/1934 | Tevander | 53/282 X |
| 2,056,330 | 10/1936 | Scott | 93/36.8 |
| 2,634,564 | 4/1953 | Bergstein | 53/210 X |
| 2,790,287 | 4/1957 | Kraft et al. | 53/19 J |
| 2,805,533 | 10/1957 | Holstebroz | 53/387 X |
| 2,858,657 | 11/1958 | Guthrie | 53/218 |
| 2,909,875 | 10/1959 | Imbs | 53/378 |
| 3,035,379 | 5/1962 | Cloots | 53/234 X |
| 3,041,806 | 7/1962 | Burt et al. | 53/172 |
| 3,057,126 | 10/1962 | Chalmers | 53/24 |
| 3,136,104 | 6/1969 | Geer et al. | 53/234 |
| 3,280,686 | 1/1966 | Gaobert | 53/33 |
| 3,327,452 | 6/1967 | Cranston, Jr. et al. | 53/218 |
| 3,857,221 | 12/1974 | Schermund | 53/234 |

*Primary Examiner*—John Sipos

*Attorney, Agent, or Firm*—Flehr, Hohbach, Test, Albritton & Herbert

[57] ABSTRACT

A high speed, automatic machine for wrapping elongate semi-rigid products such as spaghetti. The machine includes means for cutting and positioning two sheets of wrapping material during a single portion period of the machine into two tandem buckets mounted on a conveyor. The machine also includes two high speed product weighers that deposit weighted amounts of the product onto the two sheets in the two buckets. The weighers operate in duplex and each fills a bucket during a single period of pause in the motion of the machine. After filling each bucket the wrapping machine has means for folding the leading and trailing margins of the two sheets of wrapping material. The two sheets are folded during a single motion period of the machine. The two folded sheets are then simultaneously heated sealed by two, tandem wrapper sealers. Each wrapper sealer makes a complete longitudinal seal for each package during one period of pause in the motion of the machine. The wrapping machine next provides means for folding and heat sealing each open end of the two packages. The folding and sealing of the two packages is performed simultaneously by two tandem, duplex operated, finger and wrapper sealer assemblies.

18 Claims, 39 Drawing Figures

BUCKET FILLING DURING PAUSE PERIOD

LONGITUDINAL WRAPPER FOLDING DURING MOTION PERIOD

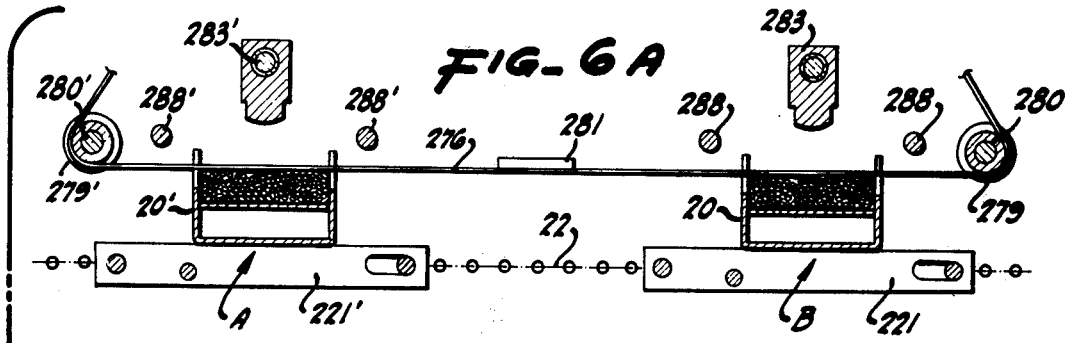
LONGITUDINAL WRAPPER SEALING DURING PAUSE PERIOD
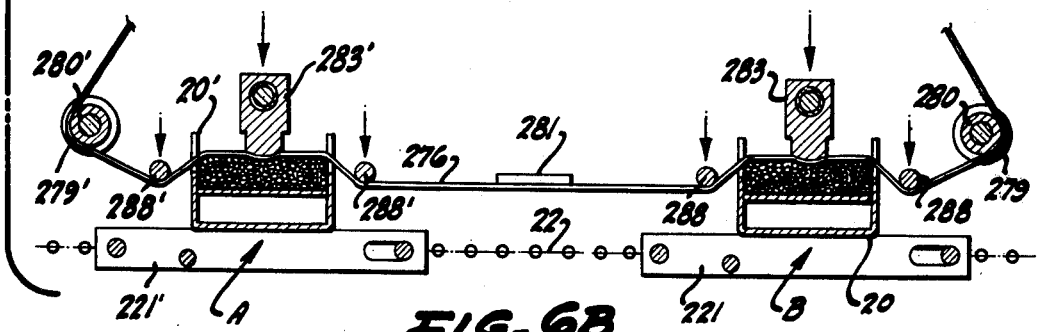
FIG. 6B
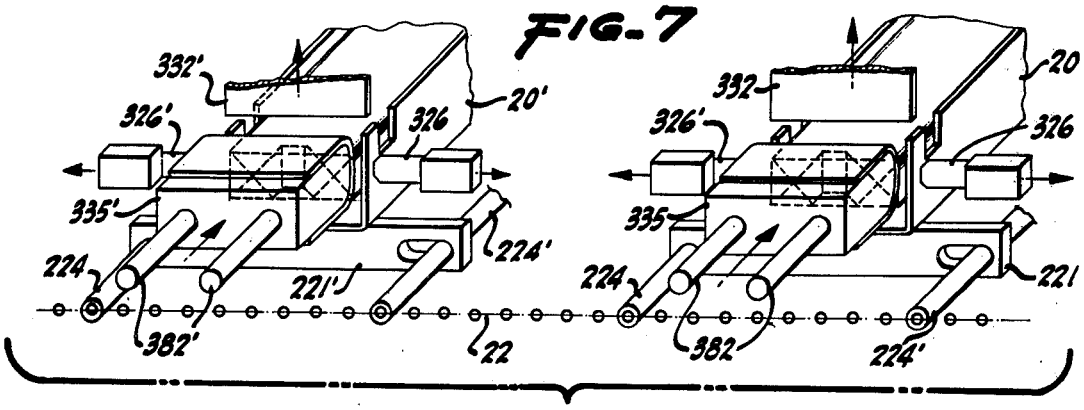
WRAPPER END FOLDING AND SEALING DURING PAUSE PERIOD 1ST WRAPPER PLACED ON FIRST BUCKET
CHAIN STOPS MOMENTARILY & SECOND WRAPPER CUT
2ND WRAPPER PLACED ON SECOND BUCKET
3RD WRAPPER CUT
WRAPPER FEED & MAIN CHAIN TIMING DIAGRAM
CHAIN PAUSE PERIOD
CHAIN MOTION PERIOD
0°
90°
180°
270°

28
28
402
439
436
434
433
444
441
443
442
431
423
421
429
427
430
432
415
380
414
411
412
413
423
405
404
406
408
420
422
378
379
85
403
414'
412'
406'
406
406'
418
380
22

437
436
439
434
431
441
444
431
429
426
427
431
433
443
414
411
326
442
421
422
415
416
423
408
412
326'
420
404
443'
422
409
406
431'
406
403
437'
378
405
444'
379
414'
411'
412'
406'
406'
405'

PRODUCT WRAPPING MACHINE AND METHOD

CROSS REFERENCE TO RELATED APPLICATIONS

This application is a continuation-in-part application of an earlier filed co-pending application entitled "Improved Product Wrapping Machine and Method," by Rene J. Gaubert, Ser. No. 654,597, filed Feb. 2, 1976 now abandoned.

BACKGROUND OF THE INVENTION

This invention generally relates to packaging machines and, more particularly, to those machines that wrap and seal sheets of packaging material around loose, elongated products.

It should be appreciated at the outset that packaging products such as spaghetti, straws, carrots, celery, licorice sticks and macaroni is particularly difficult. For example, spaghetti is not only rigid and brittle but also is easily tangled and broken. In addition, because of their elongated shape these products are not easily adapted to packaging in flexible film.

In recent years various machines have been developed for packaging these elongated, semi-rigid products. Generally, these machines wrap the packaging material around the product rather than inserting the product into a preformed container. One such machine is disclosed in U.S. Pat. No. 3,109,502, entitled "Spaghetti Wrapping Machine and Method," issued on Nov. 5, 1963, and its Continuation-in-Part, issued on Jan. 25, 1966, as U.S. Pat. No. 3,203,686. In particular, the machine described in these patents processes weighted amounts of the product in turn, step by step. Sheets of wrapping material are singularly cut and positioned one by one onto buckets mounted on a bucket conveyor. The machine weighs out the product in single lots and deposits each lot in turn into one of the buckets. The complete longitudinal seal for each package is made in two operational steps, i.e. tacking and closure sealing. These steps are performed in turn, one after the other on each package. The end seal is made on each package by arcuately moving fingers and a laterally displaceable heat sealer. The step of end sealing is likewise performed on each package in turn, one at a time, as the packages pass through the machine.

Although this machine and other machines in the prior art operate satisfactorily, there is a need in the packaging industry for new machines that can operate faster and more efficiently. There is a continuing effort in this industry to develop better machines that can package more products in fewer operations and at lower operating costs.

OBJECTS AND SUMMARY OF THE INVENTION

It is the primary object of the present invention to provide an automatic packaging machine that overcomes the limitations and disadvantages of prior wrapping machines and methods.

Another object of the present invention is to provide an automatic packaging machine for wrapping loose, elongated products at speeds higher than prior machines and with a higher net output of packages per hour.

A further object of the present invention is to provide an automatic wrapping machine that packages loose, elongated products with fewer operations and with simpler mechanical steps in each operation.

Still another object of the present invention is to provide an automatic wrapping machine that is mechanically superior to the prior machines and which is more economical to operate.

The foregoing and other objects are achieved by a high speed product wrapping machine which includes an endless conveyor having a plurality of elongated buckets that are spaced apart, upwardly faced and that are cyclically driven with periods of pause between periods of advancing movement. The wrapping machine also includes means for cutting rolls of wrapping material into sheets of predetermined dimension and for successively advancing these sheets over each of two of the buckets during each period of advancing movement. The wrapping machine has two high speed product weighers that deposit two predetermined amounts of the product upon the sheets and into two of the buckets during each period of pause of the conveyor. The wrapping machine further includes means for folding the leading and trailing margins of the sheets over the top of the product deposited into two of the buckets during each period of advancing motion. Thereafter, the wrapping machine has means for longitudinally heat sealing the folded leading and trailing margins of the two sheets during each period of pause. In addition, the wrapping machine includes means for folding the side margins of the sheets in two of the buckets over the ends of the product and for forming a heat seal between the folded end margins during a period of pause of the conveyor.

Additional objects and features of the invention will appear from the following description in which the preferred embodiment has been set forth in detail in conjunction with the accompanying drawings.

BRIEF DESCRIPTION OF THE DRAWINGS

FIG. 3A and 3B are of diagrammatic views of the feeding of sheets of wrapping material in the machine of FIG. 1.

FIG. 6A and 6B are diagrammatic views of the heat sealing of two packages in two of the buckets in the machine of FIG. 1.

FIG. 7 is a diagrammatic view of the heat sealing of the ends of two packages in two of the buckets in the machine of FIG. 1.

DESCRIPTION OF THE PREFERRED EMBODIMENT GENERAL DESCRIPTION

Figure 1:
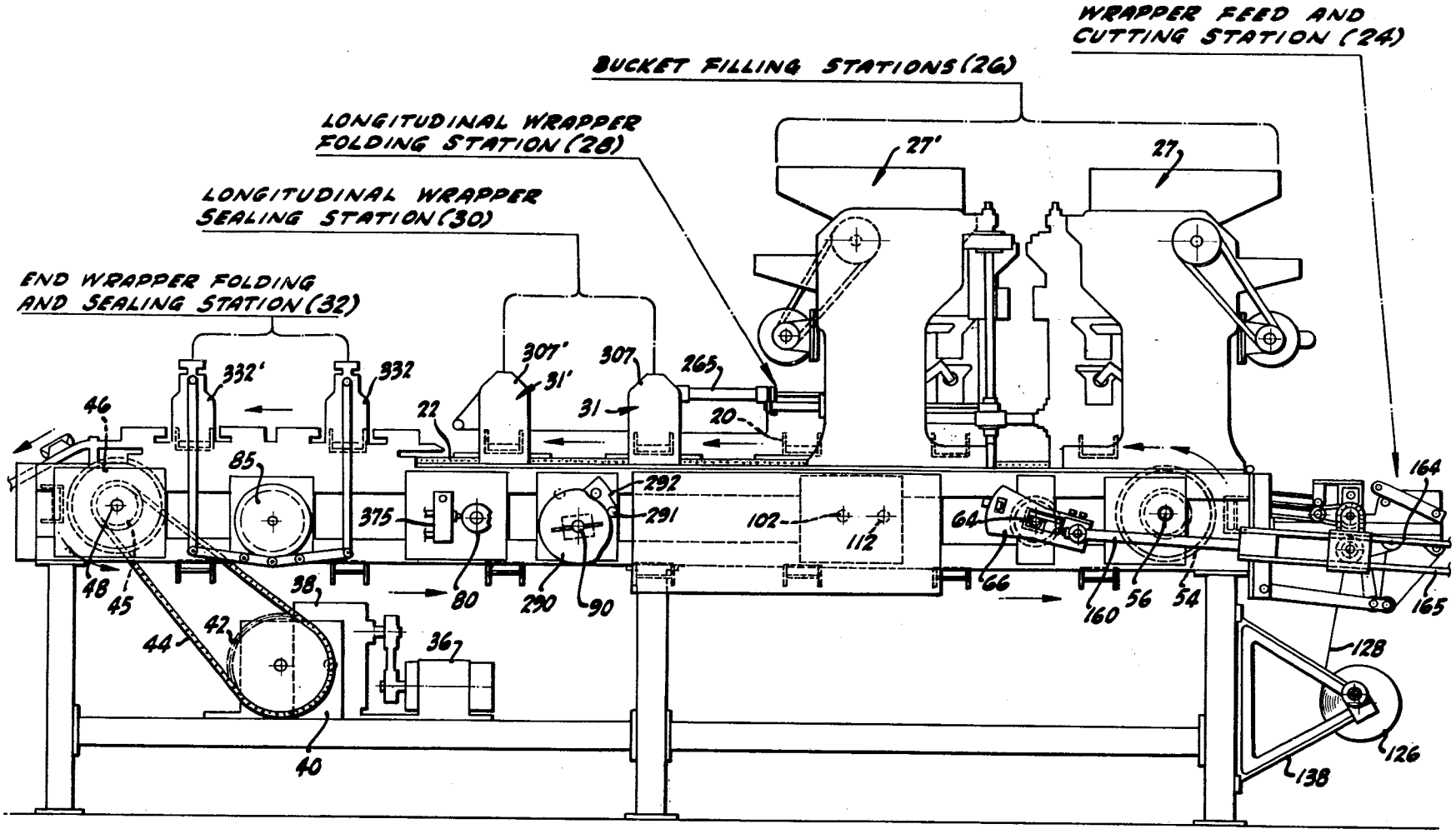
FIG. 1 is a side elevational view of an improved product wrapping machine according to the present invention.
Figure 2:
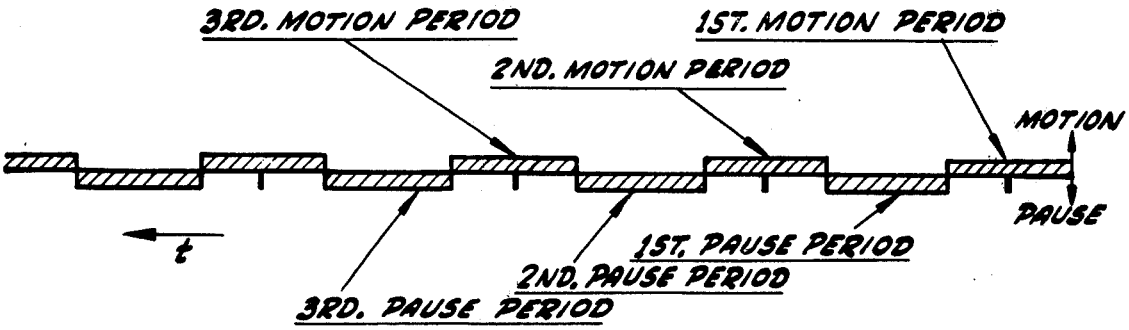
FIG. 2 is a diagram illustrating the periods of motion and pause in the operation of the wrapping machine of FIG. 1.

The automatic wrapping machine illustrated in FIG. 1 includes a plurality of buckets 20 which are longitudinally transported by a main chain 22 through the machine. The chain travels intermittantly in the direction shown by the arrows. For the purposes of explanation the motion of the main chain is broken down into motion periods and pause periods which are illustrated in FIG. 2. The spacing between the various processing stations on the machine is related to the intermittant motion of the main chain 22 such that the buckets travel in tandem from one station to the next. The buckets pause for operations at some of the stations and are operated upon while in motion through the other stations.

The wrapping machine of FIG. 1 includes a wrapper feed and cutting station 24 where the wrapping material is unrolled and cut to predetermined lengths. As each bucket 20 passes through this station, a sheet of the cut wrapping material is laid over the open face of the bucket and is anchored in place. During each motion period of the machine, FIGS. 2, 3, 23, two sheets of wrapping material are placed over two buckets moving in tandem through the station.

Figure 4:
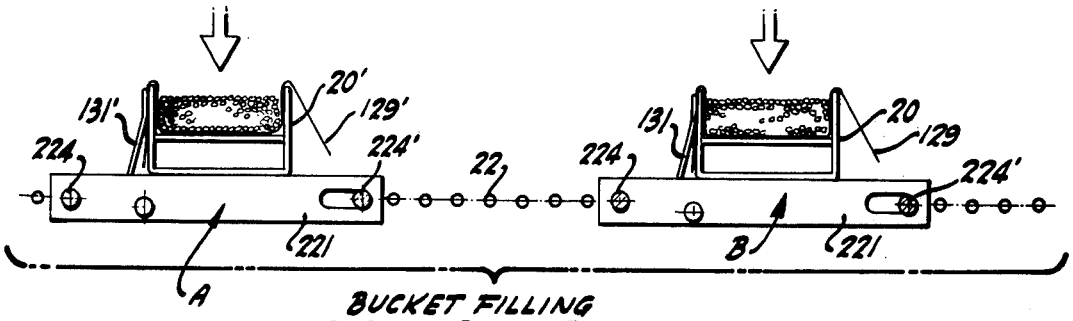
FIG. 4 is a diagrammatic view of the filling of two buckets in the machine of FIG. 1.

The machine also includes two high speed product weighers 27, 27′ located at the bucket filling station 26. The weighers deposit weighted amounts of the product onto the two sheets in the two underlying buckets. The weighers operate in duplex as illustrated in FIG. 4 and and each fills a bucket during each pause period, FIGS. 2, 23, of the machine.

After filling each bucket the wrapping machine has means located at the longitudinal paper folding station 28, FIG. 1, for folding the leading and trailing margins of the two sheets of wrapping material. The two sheets are folded over to form cylindrical packages surrounding the product as illustrated in FIG. 5. This operation occurs during each period of motion, FIG. 2. The folded sheets are prevented from opening by a plurality of flexible ribbons that parallel the path of the buckets.

Next the machine heat seals the two folded sheets at the longitudinal paper sealing station 30, FIG. 1. Two heating units operate in duplex and each seals the entire longitudinal side of a package. Two longitudinal seals are made simultaneously, FIG. 6, in two packages at the station during each pause period, FIGS. 2, 23. The heat is applied through the flexible ribbons which prevent the leading and trailing margins of the wrapping material from unfolding.

Each package thus formed next proceeds as an open ended tube to the end wrapper folding and sealing station 32, FIG. 1. At this station the machine folds the open ends of the two packages to overlie the product and seals each wrapper in position, FIGS. 7, 8. The folding and sealing of the two packages is performed simultaneously by two tandem, duplex operated, finger and wrapper sealer assemblies. This operation occurs during each period of pause, FIG. 2, in the machine's operation.

The packages leave the end wrapper folding and sealing station 32, FIG. 1, completely wrapped and sealed. Thereafter the packages are transported away from the automatic wrapping machine upon a conveyor belt (not shown). This conveyor leads to a convenient location for boxing and further processing of the package product.

the preferred embodiment has specific application to the packaging of bulk spaghetti. However, it should be understood that the present invention also has application in the packaging of any elongated, semi-rigid product such as straws.

It should be appreciated that the automatic wrapping machine of the present invention includes a plurality of buckets 20 that are all mounted on the translated by the main chain 22. These buckets move in tandem from station to station through the machine. That is to say two by two, one after the other, in sequence. For reasons of both clarity of brevity the motion of only two of the buckets will be described in certain sections herein. Likewise, the diagram of main chain movement in FIG.

2 illustrates only the motion and pause of two selected buckets. It should be understood, however, that all of the buckets undergo the same operations at each station and the apparatus at each station continuously operates on each pair of passing buckets.

THE POWER TRAIN

Figures 8A, 8B, 8C, 8D, 8E, 8F, 9:
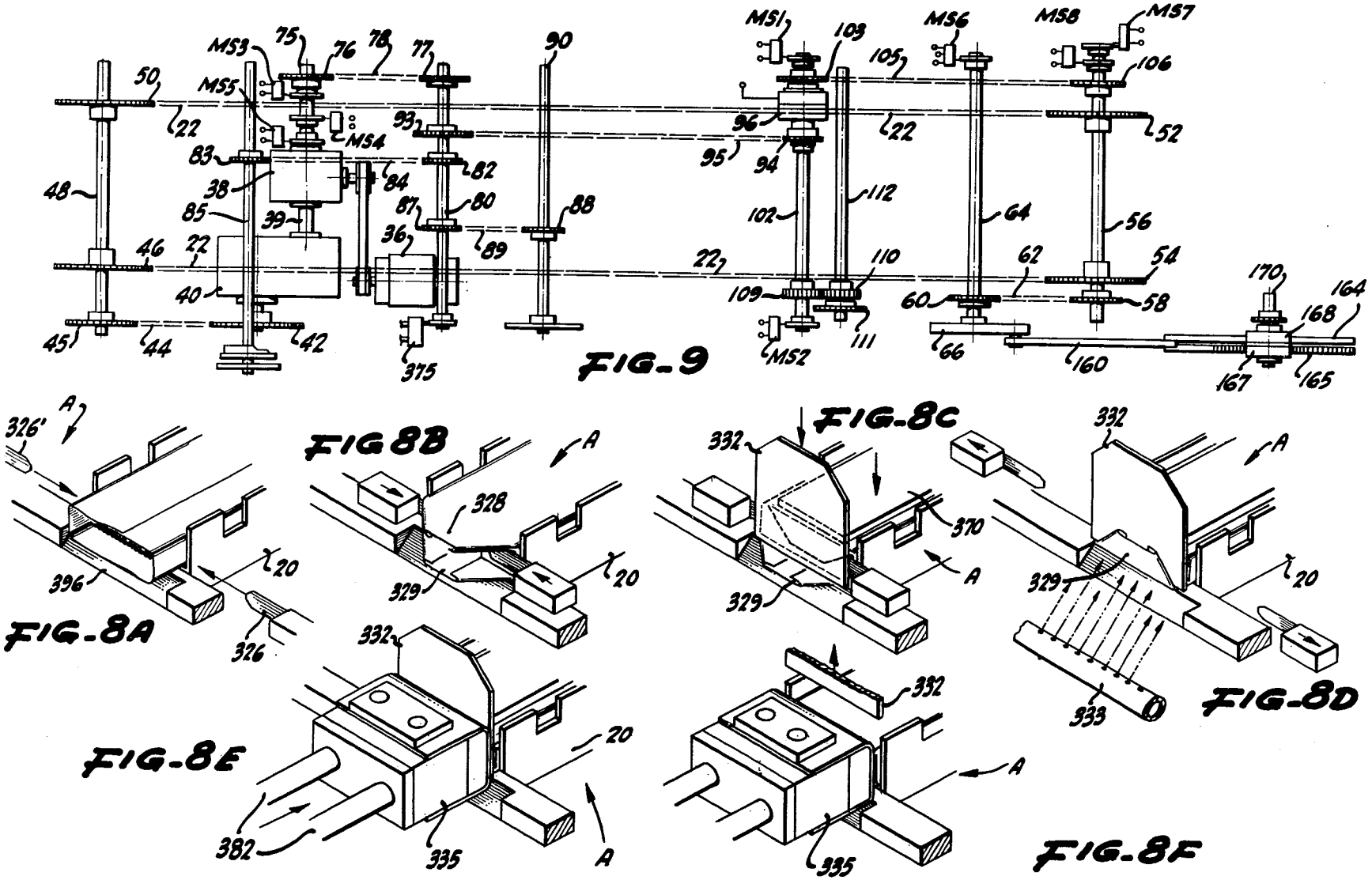
FIG. 8A–8F are diagrammatic views further illustrating the folding and sealing operation shown in FIG. 7.
FIG. 9 is a schematic, plan view of the drive train of the machine of FIG. 1 illustrating the relationship of chains, sprockets and torque shafts.

Referring to FIGS. 1 and 9, the wrapping machine is powered by a drive motor 36, which is a conventional D.C. electric motor. The speed of the motor and in turn the speed of the machine is controlled by a rheostat 502, FIG. 22. The output shaft of the drive motor is connected to a gear box 38 by a V belt passed between two pulleys. The gear box acts as a speed reducer for the drive motor.

Figures 10, 23:
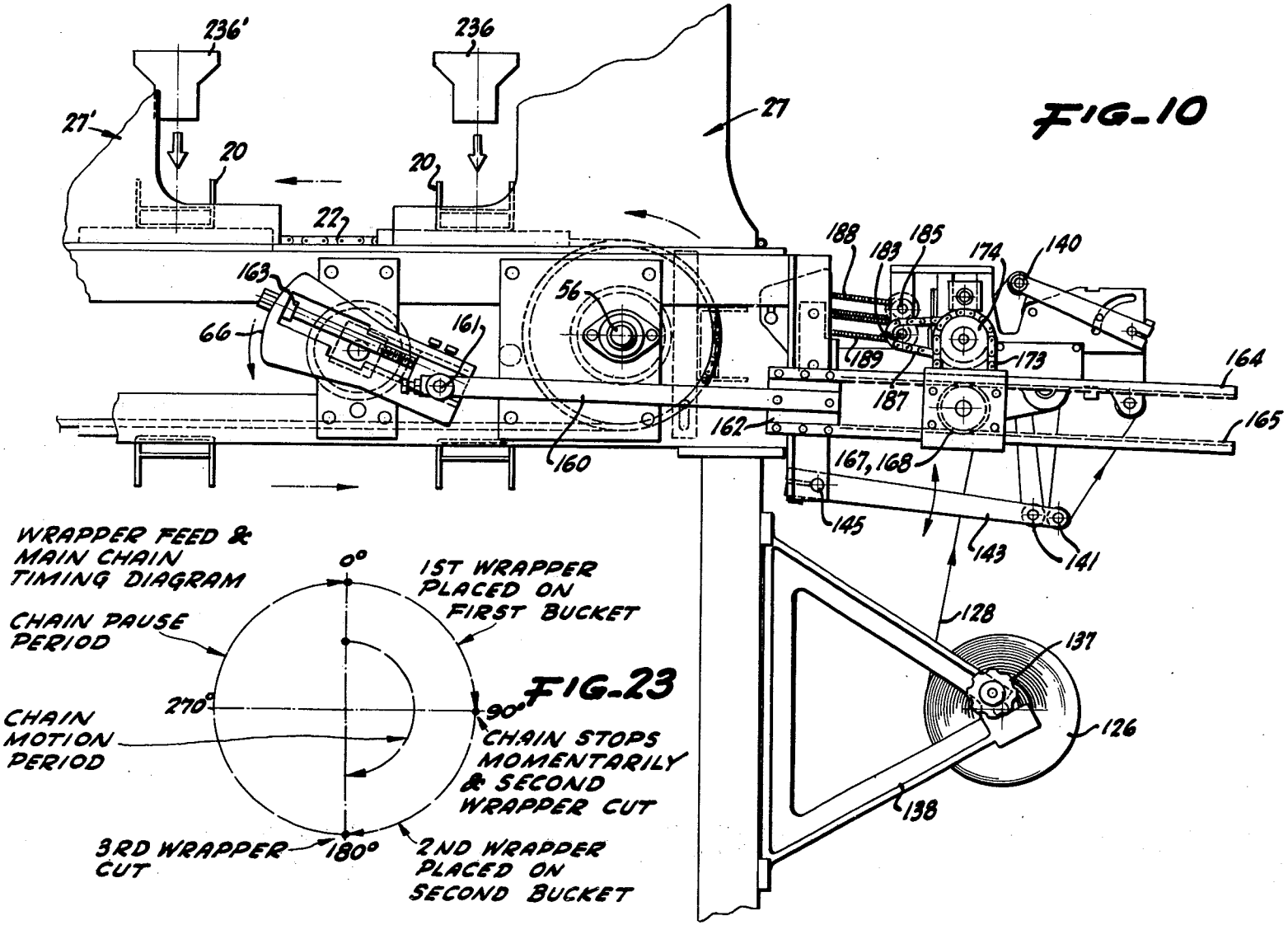
FIG. 10 is a side elevational view of the wrapper feed and cutting station of the machine of FIG. 1.
FIG. 23 is a timing diagram of the wrapper feed and main chain.

One output shaft 39 of the speed reducer is connected to an intermittent drive unit 40. The intermittent drive unit is a P500 Paradromic Indexing Drive Unit with a 65F reducer that can be purchased from the Ferguson Machine Co. of 1182 Lockland Road, St. Louis, Missouri. The movement in this drive unit converts the continuous output from the gear box 38 into an intermittent motion. This intermittent motion consists of alternating periods of motion and pause and is illustrated in FIGS. 2 and 23. Referring to FIG. 23, each period of motion is divided into equal sub-periods of 90°. The two sub-periods are separated by a momentary stoppage of the machine. Each period of pause of the intermittent motion corresponds to 180°. It should be noted that the duration of the motion and pause periods varies proportionally with the speed of the machine and hence only relative values are illustrated. Unless otherwise noted, the term, "motion period" as used herein refers to a period of 180°.

Attached to the output shaft of the intermittent drive unit 40, FIGS. 1 and 9, is a first main dirving sprocket 42. Each period of motion illustrated in FIGS. 2, 23 corresponds to 180° of rotation of the first main driving sprocket 42. During each period of pause the sprocket does not rotate. The first main driving sprocket is connected to a second main driving sprocket 45, FIG. 1 by a main driving chain 44. The second main driving sprocket 45 is connected by a torque shaft 48, FIG. 9 to the first and second main driving sprockets 46, 50 which power the main chain 22. Thus, the output shaft of the intermittent drive unit 40 causes intermittent rotation of the torque shaft 48 and intermittent motion of the main chain 22.

The main chain 22, FIG. 9, comprises two endless parallel chains that extend substantially the full length of the machine. The chain is driven by the first and second main driving sprockets 46, 50 located discharge end of the machine. Main sprocket gears 52, 54 located at the input end of the machine are driven by the main chain 22. These sprocket gears are connected together on a common torque shaft 56. This torque shaft in turn drives the first and second wrapper drive sprockets 58, 60 which are connected together by the wrapper drive shaft 64 which turns a crank arm 66. The crank arm powers the wrapper feed rollers in the paper feed and cutting station 24, FIG. 1 hereinafter described.

In addition to the intermittent drive, the wrapping machine also includes a continuous drive train. The continuous drive train originates from the other output shaft 75, FIG. 9 of the speed reducing gear box 38. Both output shafts 39, 75 from the gear box rotate continuously. The output shaft 75 is connected by two sprockets 76, 77 and an interconnecting chain 78 to the continuous drive main torque shaft 80. The continuous drive main torque shaft 80 is connected by two sprockets 82, 83 and a chain 84 to the end folding and sealing station drive shaft 85. This drive shaft powers the finger and wrapper sealer assemblies that seal the open ends of each package at station 32, FIG. 1. The continuous drive main torque shaft 80 is also connected by two sprockets 87, 88 and a chain 89 to the longitudinal sealing station drive shaft 90. This drive shaft provides the torque which moves the heating elements that seal the longitudinal fold of the package at station 30, FIG. 1.

In addition, the continuous drive main torque shaft 80, FIG. 9 is also connected by two sprockets 93, 94 and a chain 95 to a solenoid operated clutch 96. This clutch engages and disengages the output shaft from sprocket 94 and is operated by a microswitch MS-4. This microswitch is actuated by a cam, FIG. 9 located on the output shaft 75 of the speed reducing gear box 38. When the clutch is engaged, it rotates the weigher drive torque shaft 102. Although this shaft 102 is part of the continuous drive train, its motion is intermittent and is controlled by the microswitch MS-4. The torque shaft 102 is connected by the sprocket 103 and the chain 105 to the first weigher master timing gear 106. The master weigher timing gear 106 drives the first weigher 27, FIG. 1 such that it separates the product from a bulk source, weighs it, and delivers the weighted amount into an underlying bucket 20. The weigher drive torque shaft 102, FIG. 9 is also connected by two intermeshing gears 109, 110 to the second weigher master timing gear 111. This timing gear 111 drives the second weigher 27' in the same manner as the first weigher 27. Thus the two master weigher timing gears, 106, 111 are driven simultaneously and intermittently by the solonoid operated clutch 96.

It should be noted that although the first weigher master timing gear 106, FIG. 9 is mounted on the torque shaft 56, the weigher timing gear 106 rotates independently of this torque shaft. Torque shaft 56 rotates with the sprockets 52, 54 and the main chain 22. It should also be noted that sprocket 94 can only rotate shaft 102 and sprockets 103, 109 when the clutch 96 is engaged. When the clutch is disengaged, sprocket 94 continues to rotate but shaft 102 is not driven.

It should further be noted that for the purposes of clarity in FIG. 9 the tension adjusting sprockets, idler gears, and idler shafts have not been disclosed and illustrated. These parts are, of course, required in any power train of the type described above. However, it is believed that the installation of such gears and sprockets would be obvious to anyone having skill in this art.

In summary, the intermittent drive portion of the power train is driven by the output of the intermittent drive unit 40. This drive unit rotates torque shafts 48, 56, and 64. These torque shafts drive the main chain 22 and rotate the crank arm 66 which drives the wrapper feed rollers. The continuous drive portion of the power train is driven by the output shaft 75 of the speed reducing gear box 38. This output shaft rotates the torque shafts 80, 85, 90 and the inut to the solonoid operated clutch 96. The torque shafts 85, 90 drive wrapper end folding and sealing station 32, FIG. 1 and the longitudinal wrapper sealing station 30, FIG. 1. Further, the continuous drive input to the solonoid operated clutch 96 is converted into an intermittent drive by the cam operated microswitch MS-4. This drive, which does not come from the intermittent drive unit 40, in turn powers the first and second weighers 27, 27', FIG. 1.

THE WRAPPER FEED AND CUTTING STATION

Referring to FIGS. 1, 3 and 10 the wrapper feed and cutting station 24 serves to transform a roll 126 of material 128 such as wrapping paper, cellophane, or polyethylene into sheets 129, FIG. 3 of predetermined length. As each bucket 20 passes through the wrapper feed and cutting station, a sheet 129 of material is laid over the open face of the bucket and is anchored in place by the fingers 131, FIG. 3.

Figure 14:
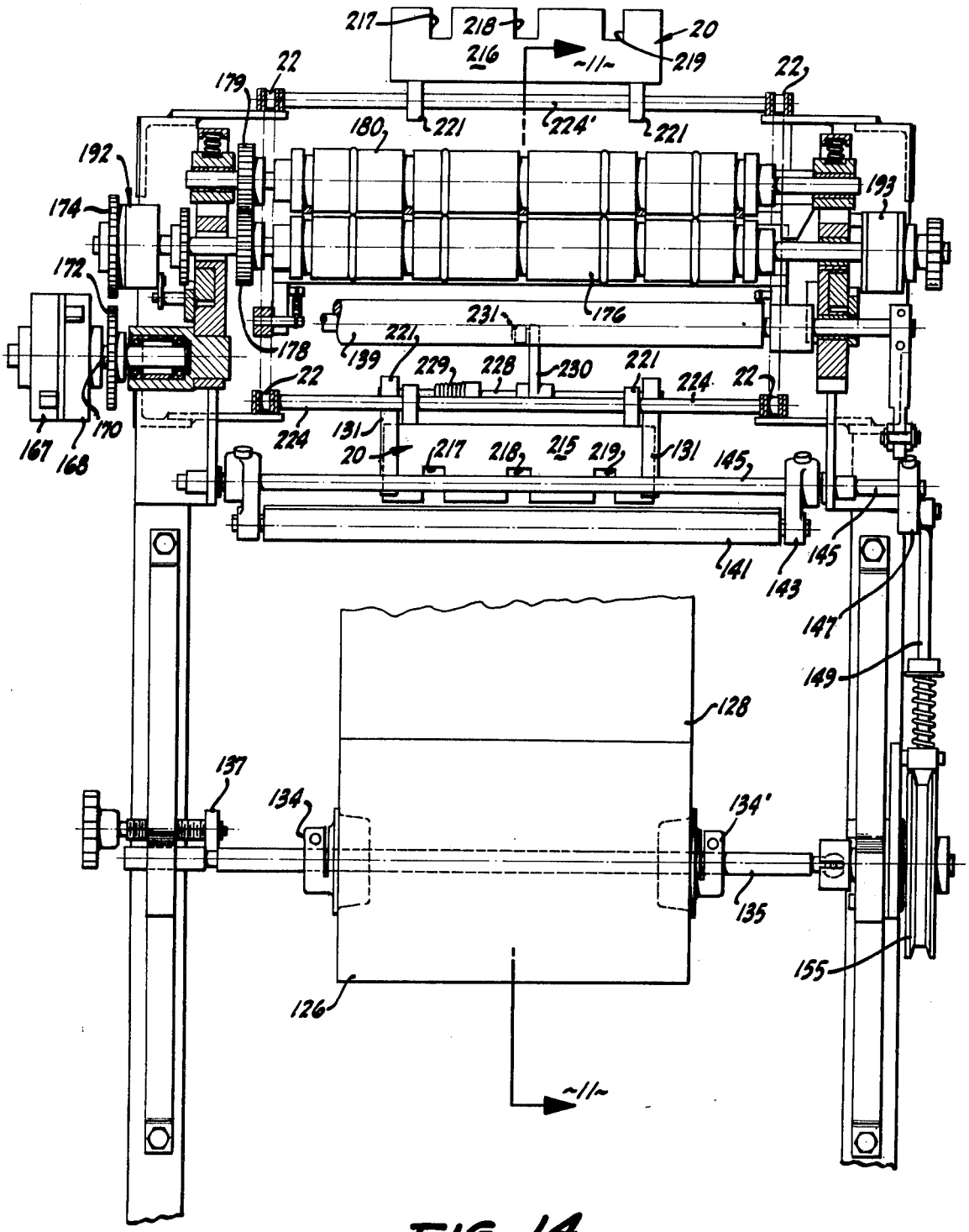
FIG. 14 is an end elevational view of the wrapper feed and cutting station of the machine of FIG. 1.

More particularly, the roll 126 FIGS. 10, 14 of wrapping material is mounted for rotation on an axle 135 by two hubs 134, 134'. As the wrapping material 128 is pulled off of the roll, the axle 135 permits the roll to turn. The axle and the roll are retained in place by a lock roller 137. The axle is mounted for rotation with respect to the frame of the wrapping machine by the triangular shaped brackets 138.

Figure 11:
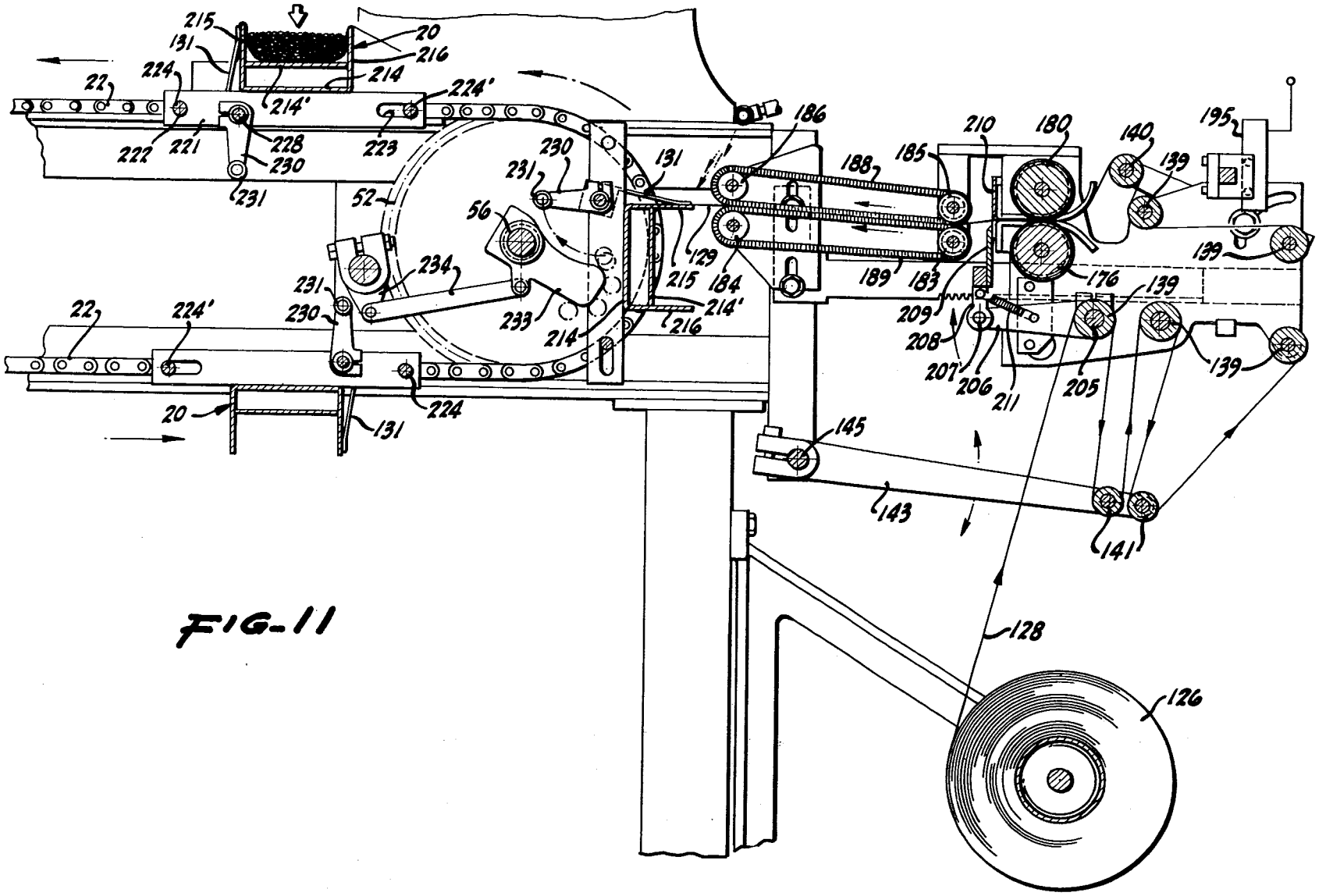
FIG. 11 is a side elevational view, in cross section, of the wrapper feed and cutting station illustrated in FIG. 10. This cross sectional view is taken along line 11—11 of FIG. 14.

Referring to FIG. 11, the wrapping material 128 is fed around five fixed idler rollers 139 which are attached to the frame of the machine. The wrappng material also passes around an adjustable idler roller 140 which can be moved to vary the angle of introduction of the wrapping material into the wrapper feed rollers. In addition, the wrapping material is threaded around two movable idler rollers 141 that are mounted between two pivot arms 143, 143', FIGS. 11, 14.

Figures 12, 13:
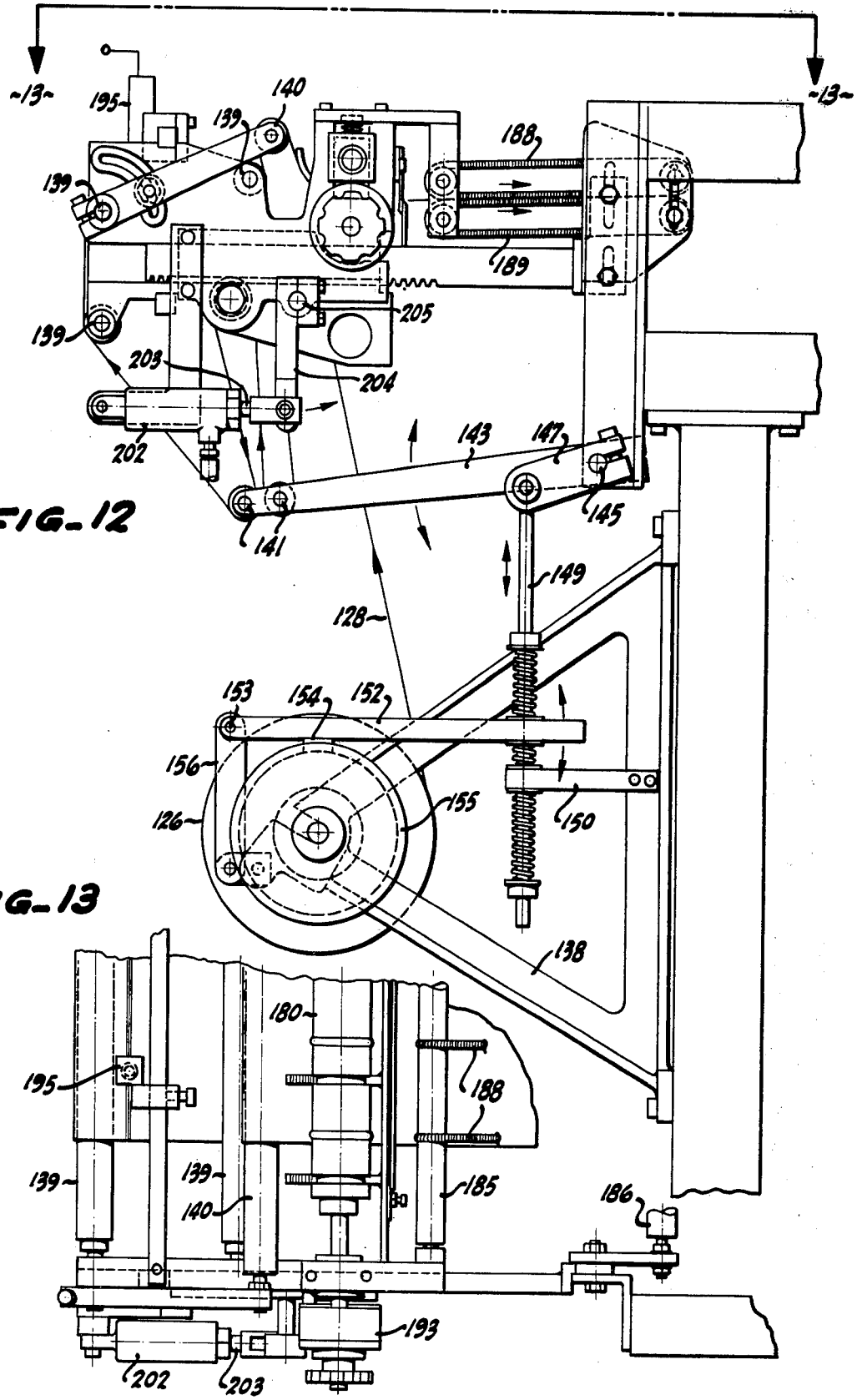
FIG. 12 is a side elevational view of the wrapper feed and cutting station of the machine of FIG. 1.
FIG. 13 is a plan view, partially cut away, of the wrapper feed and cutting station illustrated in FIG. 12. This plan view is taken along line 13—13 of FIG. 12.

When the roll of wrapping material is locked in position by a brake pad as hereinafter described, the take up of the wrapping material into the machine draws the movable rollers 141 upward causing them to pivot counterclockwise about the shaft 145 as illustrated in FIG. 11. Mounted on this rotatable shaft 145 is a second arm 147, FIG. 12 which is connected to a roll control rod 149. Referring to FIG. 12, as the movable idler rollers 141 travel in an arc about the shaft 145, the rod control arm 149 vertically reciprocates in a corresponding manner. This vertical motion of the roll control rod 149 is controlled by a stationary guide 150 which is attached to the frame of the machine. The vertical reciprocal motion of the roll control rod 149 causes a brake arm 152 to pivot around the shaft 153. The motion of the brake arm causes a brake pad 154 to either release or frictionally lock the rotation of a brakewheel 155, FIGS. 12, 14. The brakewheel is rigidly attached to the axle 135 holding the roll 126 of wrapping material. Thus, the brake pad 154 controls the unrolling of the wrapping material. The link 156 mechanically connects the pivot shaft 153 to the frame of the machine and accomodates the aforedescribed motion.

In operation, when the wrapping material 128 is drawn into the machine as illustrated in FIGS. 11 and 12, themovable idler rollers are pulled upward in an arcuate path around shaft 145. The rollers are pulled upward by the take up of the material since the roll 126 is normally locked so that it will not unroll. As the movable idler rollers 141 travel upward, the pivot arm 143 rotates shaft 145 and raises the roll control rod 149. This motion raises the brakearm 152 and lifts the friction brakepad 154 off of the brakewheel 155. When the brakepad is lifted, the roll 126 is free to rotate and unroll the wrapping material. As the roll 26 rotates, the movable idler rollers 141 ar downwardly urged by the springs on the roll control rod 149. The downward motion of the movable idler rollers occurs when the roll unwinds more material than is drawn into the machine. When the movable idler rollers travel downward, the brakearm 152 pivots clockwise, as viewed in FIG. 12, around the shaft 153. This motion causes the brakepad 154 to again frictionally engage the brake wheel 155 and lock the roll 126 in place. Thus, the wrapping material is unrolled from the roll 126 according to demand.

Referring to FIGS. 9, 10 and 11, the wrapping material 128 is drawn into the machine by the counterclockwise (FIG. 10) motion of the crank arm 66. The crank arm is intermittantly rotated by the intermittant drive unit 40 described above in the section entitled, "The Power Train." The crank arm turns simultaneously with the motion of the main chain 22 also as described above. The crank arm is connected to an operating arm 160 by a crank pin 161. The crank arm 66 contains an integral adjusting bolt 163 which permits adjustment of the radius of the circle swept out by the crank pin 161. Under normal operating conditions the position of the crank pin 161 is rigidly fixed with respect to the crank arm 66.

The operating arm 160 terminates in a rigid coupling member 162 that connects the operating arm to two, parallel opposed racks 164, 165. These racks have inward facing teeth and are horizontally and vertically spaced apart, FIG. 9. The racks 164, 165 each engage respectively an overriding clutch assembly 168, 167. Each clutch assembly contains a spur gear and a small overrunning clutch. The clutch assemblies are identical in construction and share a common output shaft 170 which is turned by each spur gear. Each clutch assembly converts the translational motion of its rack in one direction into rotation of the common clutch output shaft 170. Translational motion of its rack in the opposite direction causes the clutch assembly to freewheel and to disengage from the output shaft. Although each clutch assembly freewheels in the same direction, the clutch assemblies are installed in opposing, reversed relationship as illustrated in FIG. 14. In the embodiment actually constructed, any motion of the operating arm 160 from left to right as illustrated in FIG. 10 causes the lower rack 165 to engage its clutch assembly 167 and rotate the clutch output shaft 170, FIG. 14. The left to right motion of the upper rack 164 does not engage its clutch assembly 168 and it freewheels. When the operating arm 160 translates in the opposite direction, from right to left, the upper rack 164 engages its clutch assembly 168 and the output shaft 170 is rotated in the same direction as before. Right to left motion of the lower rack 165 does not engage its clutch assembly 167 and it free wheels. Thus, rotation of the crank arm 66 and each stroke of the operating are 160 regardless of direction continuously drives the clutch output shaft 170 in the same direction. The clutch output shaft rotates with each stroke of the operating arm because the overriding clutches alternately engage the reciprocating racks.

Referring to FIGS. 10, 14, the common output shaft 170 of the overriding clutch assemblies 167, 168, drives a sprocket 172. This sprocket is connected by a chain 173, FIG. 10 to a paper drive sprocket 174, FIG. 14. The paper drive sprocket 174 drives the lower wrapper feed roller 176, FIG. 14. The lower wrapper feed roller is connected by two intermeshing gears 178, 179 FIG. 14 to the upper wrapper feed roller 180. Referring to FIG. 11, the upper and lower wrapper feed rollers 180, 176 press together and frictionally engage the wrapping material. It is these two rollers which unroll the wrapping material from the roll 126 and pull it into the machine.

The motion of the wrapper feed rollers 176, 180 is controlled by a paper feed clutch 192, FIG. 14 and a paper feed brake 193. The paper feed clutch is a conventional microswitch-controlled electric clutch that can either engage or disengage the lower wrapper feed roller 176 from the paper drive sprocket 174. When the clutch is energized, the paper drive sprocket 174 rotates the wrapper feed rollers and when de-energized it disengages the drive sprocket 174. The paper feed brake is a conventional microswitch-controlled electric brake which can prevent rotation of the lower wrapper feed roller 176 with respect to the frame of the machine. When the brake is de-energized, the wrapper feed roller is free to rotate and when energized it stops the roller. Since the upper and lower wrapper feed rollers are geared together, the brake and the clutch in effect control the motion of both. Referring to the electrical schematic, FIG. 22, the brake and the clutch are controlled by a microswitch MS6 so that either one or the other is always energized. The microswitch MS6 is actuated by a cam FIG. 9 that is rotated by the torque shaft 64, FIG. 9.

In operation, the microswitch MS6 is normally positioned to energize the paper feed clutch 192, FIG. 14 and thereby permit the crank arm 66, FIG. 1 to drive the wrapper feed rollers 176, 180. In this position of the microswitch the brake 193 is deenergized and does not inhibit the motion of the wrapper feed roller. As hereinafter described, the motion of the wrapper through the wrapper feed rollers is periodically stopped in order to cut the wrapping material into sheets of predetermined length. When it is desired to stop the feed of the wrapping material into the machine, the cam FIG. 9 which controls microswitch MS6 shifts that microswitch and causes it to energize the brake 193 and de-energize the clutch 192. The clutch disengages the wrapper feed rollers from the driive sprocket 174 and the brake stops the motion of the wrapper feed rollers in place. When it is desired to restart the feed of the wrapping material, the microswitch MS6 is shifted to energize the clutch 192 and de-energize the brake 193. The rotation of the crank arm 66 thus again drives the wrapper feed rollers.

It should be noted that stopping the wrapper feed rollers does not stop the main chain. Unless the machine is at the end of a 90° motion sub-period, FIG. 23, the main chain 22 continues to rotate. When it is desired to feed that next sheet of wrapping material, the cam FIG. 9 which controls microswitch MS6 shifts that microswitch back and causes it to energize the clutch and de-energize the brake. Thus the cycle is repeated.

Although the microswitch MS6 controls the paper feed clutch 192 and brake 193 accurately enough for plain and uniform wrapping material, it is often desirable to control the wrapper feed rollers so that exact registration of a printed spot is obtained on each sheet. For uniform or plain wrappers a small variance in wrapper length can be tolerated. However, when operating with wrapping materials having printed spots and logos, it is particularly important to insure that the spot is properly centered on the sheet.

To provide registration for printed labels, a photoelectric cell 195, FIG. 11 is used to override the operation of the microswitch MS6 hereinbefore described. The photocell is positioned to observe the printed indicia on the wrapping material 128 and the variations in light transmittance through the wrapping material control a photoelectric relay P/E R, FIG. 22. The photoelectric relay is energized by a microswitch MS7 that is actuated by a cam FIG. 9 located on the torque shaft 56, FIG. 9. This microswitch turns off the relay during most of wrapper feeding operation in order to avoid spurious signals. When the photoelectric relay is energized and actuated by the photocell, the relay closes the photoelectric relay contact P/E R 1 thereby energizing the brake 193. The relay also opens the photoelectric relay contact P/E R 2 which de-energizes the clutch 192.

In the preferred embodiment the photoelectric relay R/E R is only energized by the microswitch MS7 while a translucent portion of the wrapping material is passing in view of the photocell. Typically for labels printed on polyethylene, there is a translucent space on the material between the trailing edge of one printed opaque label and the leading edge of the next printed opaque label. When the relay is energized, the opaque leading edge of each printed label cuts off the beam of light to the photocell and actuates the relay P/E R. This relay energizes the brake 193 and de-energizes the clutch and the motion of the wrapper is stopped. The microswitch MS7 is required to de-energize the relay while the printed portion of the label is passing in front of photocell because a printed label frequently contains translucent areas that would cause spurious signals.

Referring to FIGS. 11 and 12, the wrapping material 128 is cut into sheets 129 of predetermined length while the wrapping material is at rest. The cutting is performed by a solonoid controlled, air actuated, pneumatic cylinder 202, FIG. 12. The solonoid FIG. 22 for the cylinder is energized by a microswitch, MS5. This microswitch is actuated by a cam FIG. 9 located on the output shaft 75 of the speed reducing gear box 38, FIG. 9. When the microswitch is actuated, the operating rod 203 of the pneumatic cylinder 202 extends. The extension of this operating rod causes the arm 204 to rotate the shaft 205. This shaft in turn causes a second 206, FIG. 11 to rise. The arcuate movement of the second arm 206 also causes a blade arm 208 to rise. The second arm 206 is connected to the blade arm 208 by a pin 207. This motion in turn causes the blade 209 to rise and cut the wrapping material across the edge of the anvil 210. The blade is held against the anvil by a spring 211. The blade is retracted when microswitch MS5 opens, and the pneumatic cylinder 202 is vented.

Referring to FIG. 11, each sheet of wrapping material 128 after being cut is directed onto the buckets 20 by an upper and lower pair of wrapper transfer rollers 183–186. The first wrapper transfer roller 183 in the lower pair is driven by a chain 187, FIG. 10 which is connected to a sprocket (not shown) on the clutch output shaft 170, FIG. 14. The first wrapper transfer roller 185 in the upper pair is driven by a chain (not shown) connected to the first lower wrapper transfer roller 183. Between each pair of wrapper transfer rollers is a plurality of endless, flexible, deformable wrapper conveyor belts 188, 189. The belts gently pull each sheet into the machine while maintaining it in a flat and aligned condition. From the wrapper conveyor belts 188, 189 each sheet of wrapping material is passed over the leading front wall 215 of each bucket 20 and is anchored in place by the fingers 131, FIGS. 11 and 3.

Figure 22:
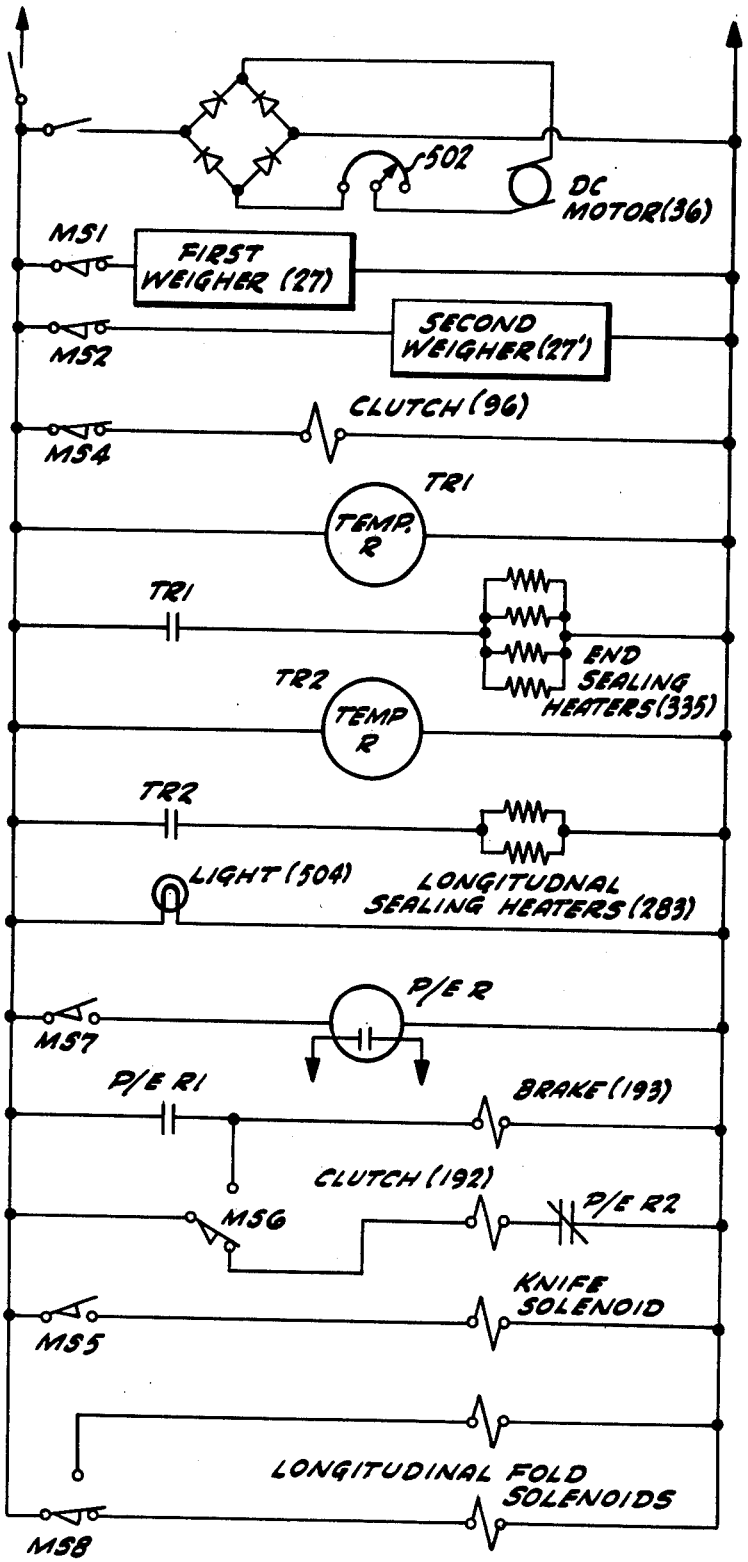
FIG. 22 is a schematic diagram of the electrical circuit of the wrapping machine of FIG. 1.

In operation, the wrapper feed and cutting station 24, FIG. 1 serves to transform a roll of wrapping material 126 into sheets of predetermined length. The apparatus comprising the station operates only during each period of motion of the machine and is at rest when the main chain 22 is stopped. The crank arm turns one full revolution during each motion period and the crank operating arm 160 makes two strokes. The motion period begins when the crank arm 66, FIG. 10 starts to turn. Microswitch MS6 is positioned as illustrated in FIG. 22 so that the paper feed clutch 192, FIG. 14 is energized and engaged and the paper feed brake 193 is de-energized and released. The counter clockwise rotation of the crank arm 66, FIG. 10, causes the two racks 164, 165 to drive the upper and lower wrapping feed rollers 176, 180, FIG. 11 through the overriding clutches 167, 168. The two wrapper feed rollers pull the wrapping material 128 off of the roll 126 and into the machine. The take up of the material into the machine causes upward motion of the two movable idler rollers 141. This motion forces the brake pad 154 to release the roll and permit the axle 135, FIG. 14 to rotate. Thus, the wrapping material is unrolled according to demand.

With microswitch MS7, FIG. 22 normally open, the relay P/E R for the photoelectric cell 195, FIG. 11 is de-energized. This avoids spurious signals. The cam actuating this microswitch is cut, however, so that as the translucent portion of the wrapping material located between each printed spot passes beneath the photocell, the microswitch MS7 energizes the relay P/E R. Thereafter, when the leading edge of the next opaque spot printed on the wrapper interrupts the photocell beam, the relay causes relay contact P/E R 2 to disengage the clutch 192 and relay contact P/E R 1 to apply the brake 193. The forward motion of the wrapping material is thus stopped and a section of wrapper of predetermined length is positioned between the wrapper conveyor belts 188, 189, FIG. 11.

The crank arm 66, however, continues to turn and thereby moves microswitch MS6 to energize the brake 193 and de-energize the clutch 192. This parallels the action of the relay P/E R. Immediately thereafter the microswitch MS7 opens and the photoelectric relay to de-energized. The status of the clutch and brake is not changed by these movements of MS6 and MS7. However, microswitch MS6 is now able to independently control the application of the brake and clutch. The photocell and its relay P/E R override the control of microswitch MS6 in order to maintain registration of the printed spots on each sheet.

Thereafter, a cam located on the output shaft 75, FIG. 9 of the speed reducing gear box 38 closes the microswitch MS5, FIG. 22 which energizes the knife solonoid. This solonoid actuates the pneumatic cylinder 202, FIG. 12 and causes the blade 209, FIG. 11 to rise and cut the stationary wrapping material across the edge of the anvil 210. Next, the pneumatic cylinder 202, FIG. 12 is vented and the knife 209 retracts downwardly out of the path of the wrapping material. This ends the first stroke of operating arm 160.

Referring to FIG. 23, the 180 ° motion period of the main chain is divided into two sub-periods of 90°. At the end of the first sub-period the main chain is momentarily stopped by the intermittent drive unit 40, FIG. 9. This stoppage is of very short duration and permits the blade 29, FIG. 11 to cut a stationary sheet of wrapping material.

Immediately thereafter the second sub-period of motion begins. The crank arm 66, FIG. 10 commences to turn and the second stroke of the crank operating arm 160 now begins. Microswitch MS6 is shifted to engage the clutch 192 and release the brake 193. The recently cut sheet of wrapping material is advanced by the wrapper conveyor belts 188, 189. These rollers and belts are driven by the racks 164, 165 through the overriding clutches 167, 168. The sheets of wrapping material (now 129) is passed over the leading, front wall 215, FIG. 11 of the upcoming bucket 20 and is anchored in place by the fingers 131 in a manner hereinafter described. The sheet thereafter passes out of the wrapper conveyor belts 188, 189, and is draped over the trailing, rear wall 216 of the bucket as illustrated in FIGS. 3A, 33. The sheet covered bucket moves on to the bucket filling station 26, FIG. 1.

The aforedescribed sheet of wrapping material is immediately followed by the leading margin of the next-to-be-cut sheet. The cutting operation performed on this next sheet during the second stroke of the crank operating arm 160 is an exact repetition of the operations performed on the first sheet during the first stroke. This next-to-be-cut sheet enters between the wrapper conveyor belts 188, 189, FIG. 11. Its forward motion is thereafter stopped by the photoelectric relay P/E R in the same manner as hereinbefore described. Next, the sheet is cut by the knife 209, FIG. 11. At this point the operating arm 160 has reached the end of its second stroke and one complete rotation of the crank arm 66 is completed. The second 90° sub-period, FIG. 23 of motion is ended, and the main chain stops.

Figure 3B:
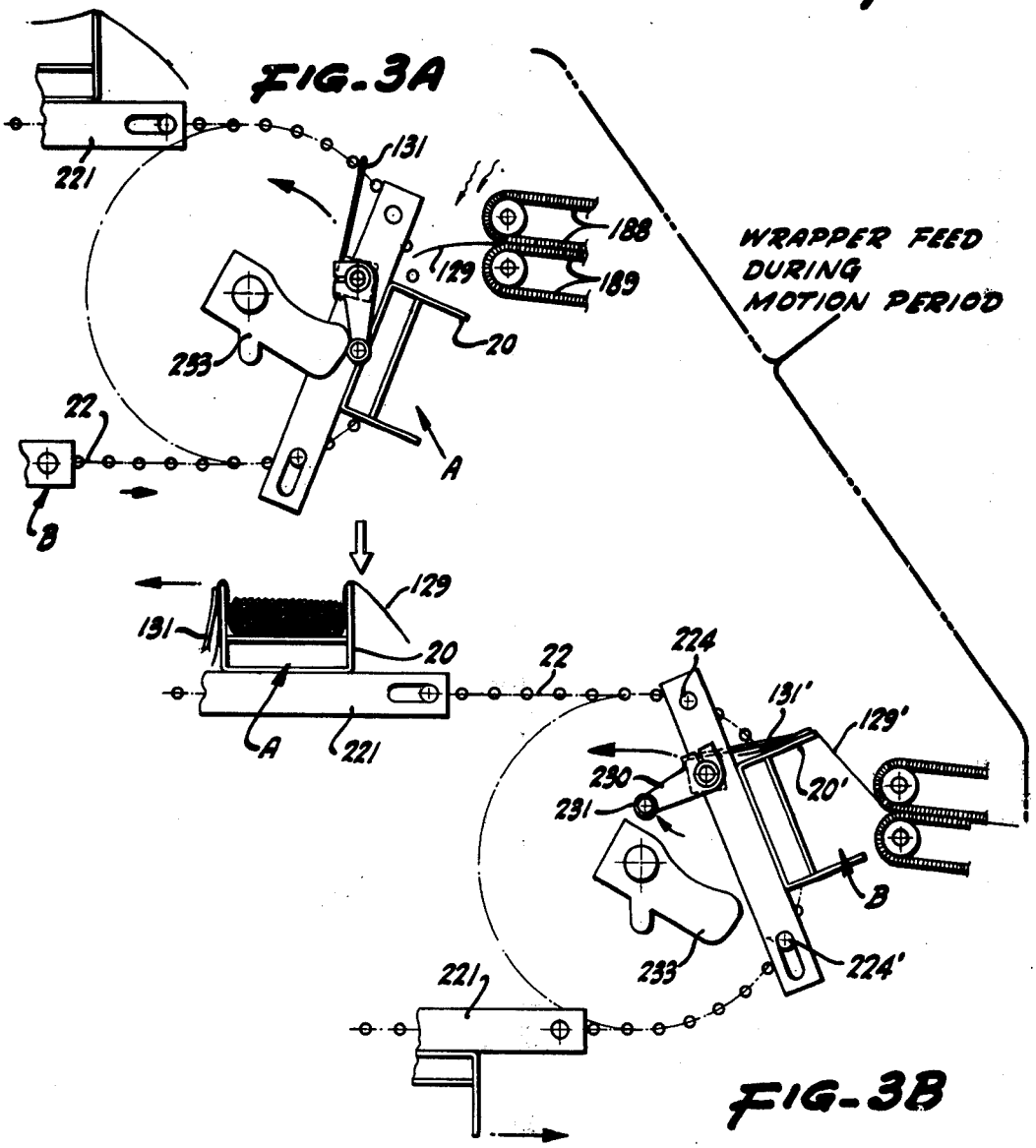

Referring to FIGS. 2, 10, 23 each period of motion (180°) of the main chain 22 includes one complete revolution of the crank arm 66. The crank arm during a complete revolution drives the racks 164, 165 for two strokes. For example, one stroke is translation of the racks from right to left and the other stroke is translation from left to right. During each stroke, no matter what the direction of motion of the racks, a sheet of wrapping material is advanced and cut. Thus, during each motion period two sheets are cut and draped over two passing buckets as illustrated in FIGS. 3A, 3B.

BUCKET AND BUCKET DRIVE

In FIGS. 11 and 14 a bucket 20 is most clearly illustrated. Each bucket comprises an open ended and open topped member having a bottom 214, a front wall 215 and a rear wall 216. The sizes of the buckets may be varied to fit individual products and the amount of which is to be packaged. As illustrated in FIG. 11, the bucket has a false bottom 214' in order to accomodate a package having lesser volume than the capacity of the entire bucket. The front and rear walls of the bucket are provided with openings 217, 218 and 219. It should be noted that the openings in both the front and rear walls are in registry. As will be hereinafter described these openings are provided to admit folding fingers and hold down ribbons located at the longitudinal wrapper folding station 28, FIG. 1 and the longitudinal wrapper sealing station 30, FIG. 1. These fingers and ribbons are utilized to maintain the wrapping material tightly folded around the product during the heat sealing operations.

The bottom 214 of each bucket is attached to two bucket bars 221 by screws or other convenient means. One end of each bucket bar is bored through at 222 while the other end has a longitudinal slot 223 therethrough. The two bucket bars 221 are clamped to a bucket shaft 224 passing through the bore 222. The slots 223 provide pivotal and sliding motion to a rear bucket shaft 224'. The shafts 224, 224' are pivotally mounted in spaced lengths along the main chains 22.

Figure 16:
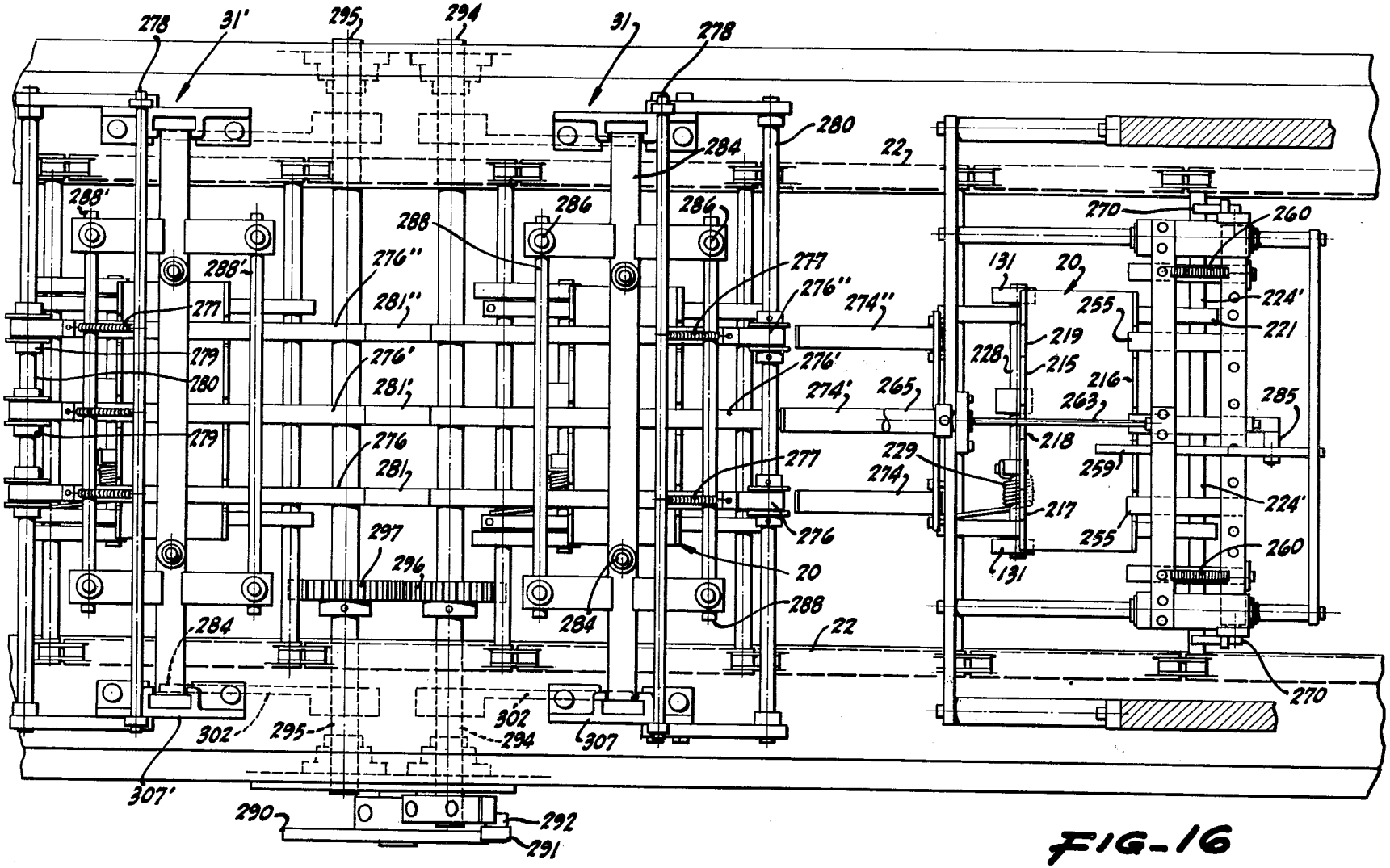
FIG. 16 is a plan view, partially cut away, of the longitudinal wrapper folding station and sealing station of the machine of FIG. 1. This view is taken along line 16—16 of FIG. 15.

Referring to FIGS. 11, 16, a shaft 288 extends between the bucket bars 221 in close proximity to the front wall 215 of the bucket. Paper hold down fingers 131 are secured about the shaft 228 and are resiliently urged against the front wall 215 of the bucket by means of a torsional spring 229, FIG. 14. Also fixed to the shaft 228 is a roller arm 230 FIG. 11, depending downwardly from the shaft 228. At the lower end of the roller arm 230 is a roller 231 which is utilized to release the paper hold down fingers 131 as hereinafter described.

The location of the various stations on the machine determines the spacing of the buckets. In the preferred embodiment each station is equally spaced apart and the spacing between the stations is equal to the bucket spacing. With such an arrangement the various station may operate in duplex on two buckets simultaneously.

BUCKET AND PAPER MANIPULATION AT THE WRAPPER FEED AND CUTTING STATION

Referring to FIG. 11, an empty bucket 20 approaches the wrapper feed and cutting station 24 upside down along the lower horizontal run of the main chain 22. The roller 231 on the arm 230 first engages a cam surface 233. This cam surface is stationary and is mounted on the shaft 56. The linkage 234 merely provides adjustment of the came about the shaft 56. When the roller 231 engages this cam surface, the arm 230 causes the paper hold down fingers 131 to open against the force of the spring 229, FIG. 16. At this moment the sheet of wrapping material 129 is advanced across the front wall 215 of the bucket by the wrapper conveyor belts 188, 189. The sheet of wrapping material was cut by the knife 209 during the previous stroke of the crank operating arm 160, FIG. 1 as described above in the section entitled "Wrapper Feed and Cutting Station."

As soon as the leading margin of the sheet extends across the front wall of the bucket, the roller 231 is released by the cam 233 and swings free. The spring loaded wrapper hold down fingers 131 catch and secure the leading margin of the wrapper against the front of the bucket. Referring to FIG. 3A, the bucket 20 advances along the arcuate path and the sheet 129 of wrapping material is draped over the top and down the rear wall 216 of the bucket. The bucket leaves the wrapper feed and cutting station in the manner illustrated by bucket A, FIG. 3A.

As illustrated in FIGS. 3A, 3B the wrapper draping sequence described above is repeated twice during eac period of motion of the main chain 22. In FIG. 23 the first or leading bucket A is draped with a previously cut wrapper during the first 90° sub-period of motion. The second wrapper is cut at the end of the first sub-period. The second or trailing bucket is draped with the second wrapper during the second 90° sub-period. At the end of the second sub-period a third wrapper is cut so that a wrapper is ready for the first bucket at the start of the next motion period.

In summary, each period of motion includes one complete revolution of the crank arm 66 and two strokes of the operating arm 160. Two sheets are thus positioned on two tandem buckets, one following the other both in time and in spatial position. These two buckets A, B, FIG. 3B with wrappers held in place by the paper hold down fingers 131 leave the wrapper feed and cutting station 24 and travel on to the bucket filling station 26, FIG. 1

BUCKET FILLING STATION

Referring to FIGS. 1, 4 and 10, the bucket filling station includes two high speed product weighers 27, 27'. These two weighers are constructed and operate in the same manner as the hopper unit described in U.S. Pat. No. 3,190,502 hereinbefore identified. Reference to this patent should be made for a more complete description of the construction and operation of these weighers.

Each weigher serves to receive an elongated, semi-rigid product from a bulk source, separate it by volume, adjust the weight of the separated amount, and deliver the weighted amount into an underlying bucket 20. In the embodiment actually constructed the weighers processed raw, bulk spaghetti. The two weighers are driven together by the solonoid operated clutch 96, FIG. 9 as described in the section entitled "Power Train." This clutch is controlled by a microswitch MS4 which is actuated by a cam located on the output shaft 75 of the speed reducing gear box 38, FIG. 9. The weighers are only driven intermittantly by the clutch through the weigher master timing sprockets 106,111.

In operation, the weighers 27, 27' fill their respective discharge chutes 236, 236' with a measured quantity of product during the first period of motion, FIG. 2. The two weighers operate in duplex under control of the microswitch MS4. During this first period of motion two buckets pass through the wrapper feed and cutting station as illustrated in FIGS. 3A, 3B. These two buckets each carrying a wrapper come to rest beneath the discharge chutes at the end of the first motion period. These buckets remain under the discharge chutes during the first pause period, FIG. 2. As illustrated in FIG. 4, both chutes dispense the product into the buckets during the first pause period at substantially the same time. The two weighted quantities of product are deposited into the underlying buckets in a manner to overlie each sheet of wrapping material. The front and rear walls 215, 216 of the buckets retain the product in place, and to some extent the trailing margin of the sheet is taken up into the bucket in order to accomodate the product. The leading margin of the sheet remains held in place by the paper hold down fingers 131 as illustrated in FIG. 11.

LONGITUDINAL WRAPPER FOLDING STATION

After the buckets filled with product leave the bucket filling station 26, FIG. 1, they pass one at a time through the longitudinal wrapper folding station 28. During the passage of each bucket through this station the trailing margin of each sheet of wrapping material is folded down over the product. Thereafter the leading margin of each sheet is folded down on top of the trailing margin. This folding sequence is performed on two sheets one at a time during each period of motion.

Figure 15:
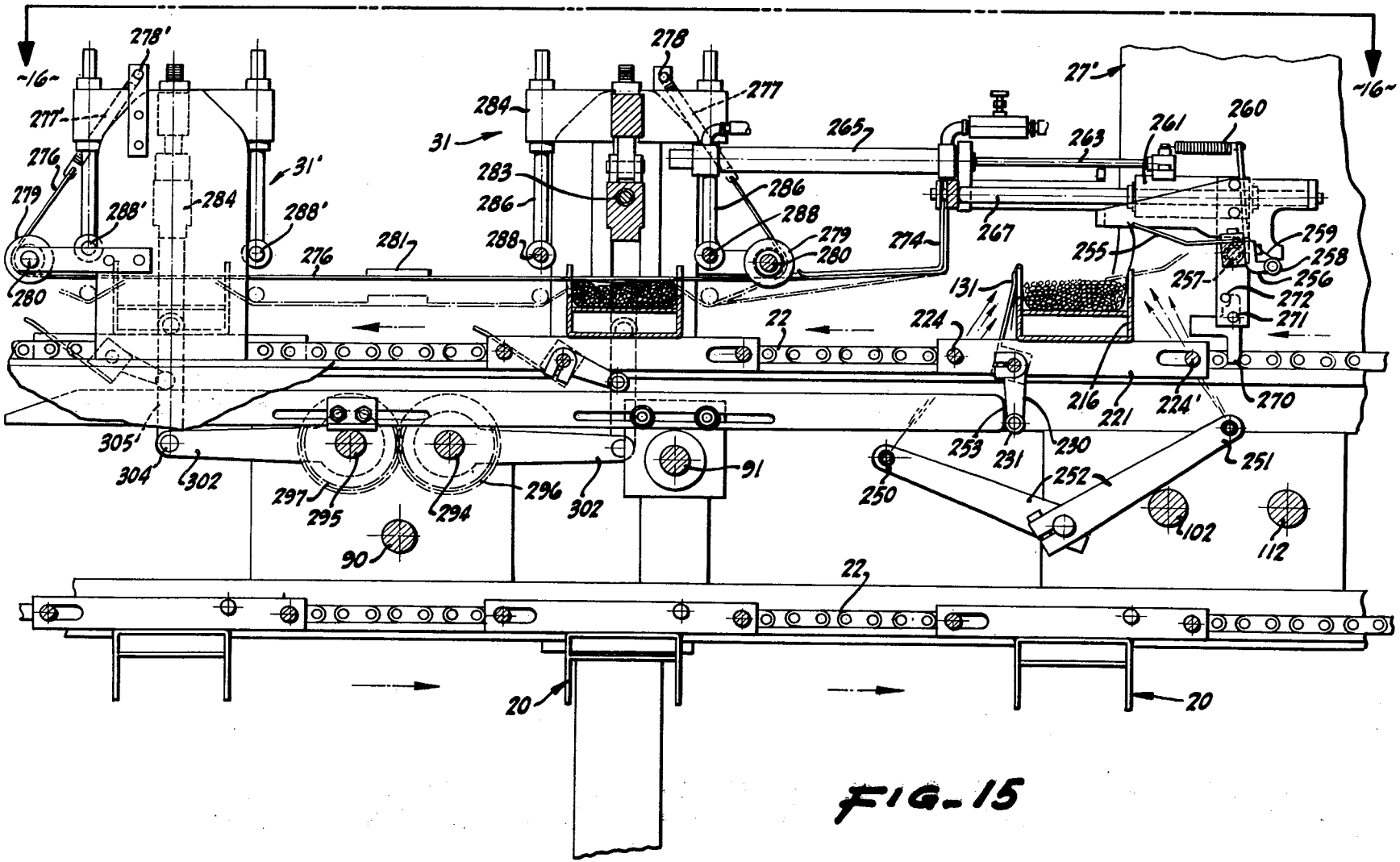
FIG. 15 is a side elevational view, partially cut away, of the longitudinal wrapper folding station and sealing station of the machine of FIG. 1.

Referring to FIG. 15, the longitudinal wrapper folding station includes two stationary air pipes that are held in position by two stationary brackets 252. The air supply to each air pipe is continuous and the streams of air are directed upwardly into the path of the buckets at all times.

When the main chain 22 advances the bucket forward, the roller 231 on the roller arm 230 of the bucket engages a stationary cam surface 253, FIGS. 5, 15, 16. This cam surface controls the opening and closing of the wrapper holddown fingers 131. Further forward motion of the bucket causes the roller to displace the roller arm and the wrapper holddown fingers 131 away from the front wall 215 of the bucket. When the holddown fingers open, the leading margin of the wrapper is released, FIG. 5B.

The folding station also includes three movable folding fingers 255 that fold the trailing margin of the wrapper down over the product. Each finger is fabricated from thin, flexible steel stock and is medially deformed into a broad V-shape. The fingers are aligned along the path of the buckets so that the free end of each finger can pass through one of the slots 217, 218, 219, FIG. 14 in the rear wall 216 of the bucket. Each movable folding finger is connected to a common arm 256 that pivots around a shaft 257. At the end of the shaft remote from the fingers is a small roller 258. This roller engages a stationary cam surface 259 that controls the inclination of the fingers. The roller is urged against the cam surfaces 259 by a resilient spring 260.

The three movable folding fingers 255, FIG. 15, 16 the common arm 256, the shaft 257, and the roller 258 are all mounted together on a longitudinally moving carriage 261. This carriage is translated by the motion of the operating arm 263 of a double acting, solonoid controlled, pneumatic cylinder 265. The two solonoids for the cylinder are energized by microswitch MS8, FIG. 22 which is actuated by a cam located on shaft 56, FIG. 9. One solonoid causes the cylinder to extend the operating arm 263 and the other solonoid causes the cylinder to retract the operating arm. The alignment of the carriage is maintained by a guide rod 267 which both supports the pneumatic cylinder 265 and supports three stationary folding fingers hereinafter described. The carriage moves in a direction parallel with the path of the buckets.

When the carriage 261, FIG. 15 is urged in a direction toward the pneumatic cylinder 265, its motion is arrested by the engagement of a pawl 270 with the rear bucket shaft 244'. The pawl pivots around a shaft 271 and engages a stop 272. The pawl 270, the shaft 271, and the stop 272 are all mounted by a bracket to the moving carriage 261 which holds the movable folding fingers 255. The purpose of the pawl 270 is to maintain the sliding carriage 261 in step with each bucket as the buckets pass through the station from right to left as illustrated in FIG. 15. When each bucket has passed through the station, the pawl 270 also permits the pneumatic cylinder to retract the carriage by passing the pawl 270 over the bucket shafts 224, 224' of the next-to-be processed bucket.

The leading margin of each wrapper is folded by three stationary fingers 274. These stationary fingers are L-shaped and are attached to the end of the guide rod 267. Each finger is fabricated from thin, flexible steel stock. The stationary fingers are aligned along the path of the buckets so that the horizontal portion of each finger can pass through one of the slots 217, 218, 219, FIG. 14.

Figure 5A:
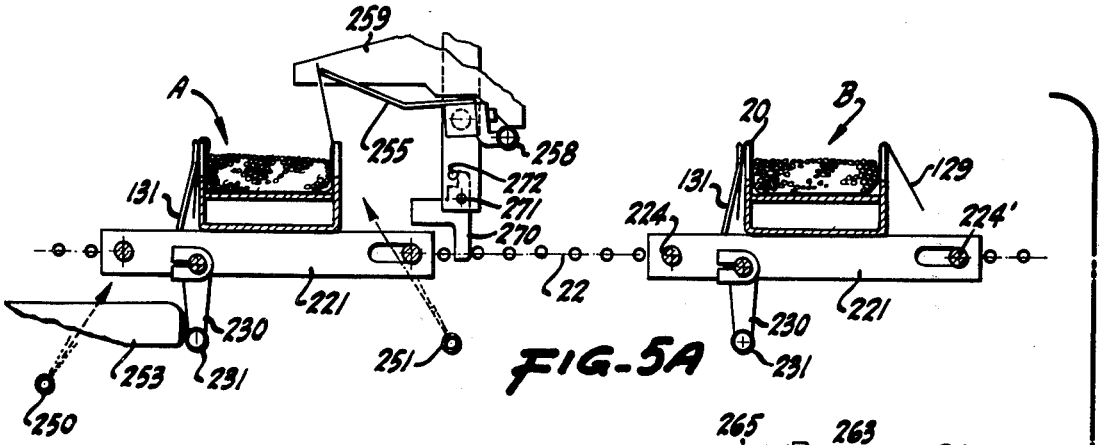
FIG. 5A–5D are diagrammatic views of the longitudinal folding of a wrapper in the machine of FIG. 1.

The longitudinal folding sequence begins on a bucket which has been waiting at the station during the previous pause period. The carriage 261, FIG. 15 is being urged against the bucket shaft 224' and the movable fingers 255 have partially folded the trailing margin of the wrapper. Roller 258 has partially traveled along the cam surface 259. The first air pipe 251 is directing a stream of air that blows the trailing margin of the sheet upward to a vertical position as illustrated in FIG. 5A.

When the motion period begins, the main chain and the buckets start to move from right to left as illustrated in FIGS. 5 and 15. The carriage and the bucket move together in step because the carriage is urged against the rear bucket shaft 224' by the pneumatic culinder 265. As the carriage 261 moves forward with the bucket, the roller 258 travels along the stationary cam surface 259 and the movable folding fingers 255 thereby fold the trailing margin of the wrapper down over the product as illustrated in FIG. 5B.

Figure 5B:
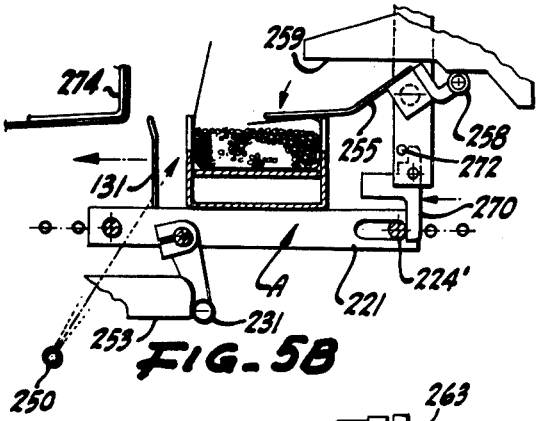
Figure 5C:
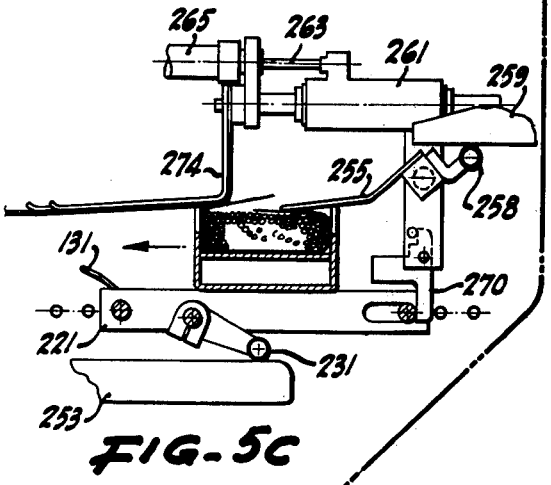

During this time the leading margin of the wrapper is released by the wrapper hold down fingers 131, FIG. 5B. The margin is then blown vertically upward by the air pipe 250. Next, the vertical portion of the stationary fingers 274 folds the leading margin of the sheet down on top of the trailing margin, FIG. 5C.

Figure 5D:
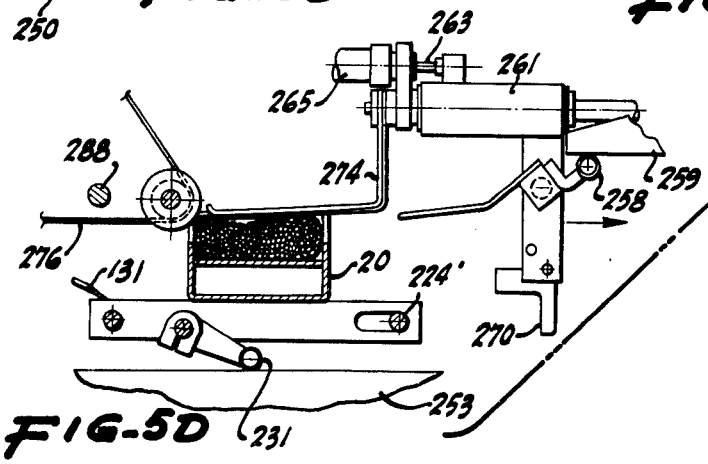

The bucket thereafter passes completely under the stationary fingers, FIG. 5D and the carriage 261 is retracted. The carriage is retracted by extending the operating arm 263 and passing the pawl 270 over the bucket shafts 224, 224' of the next-to-be processed bucket. FIGS. 5A and 15 illustrate the carriage 261 in its fully retracted position. The longitudinal fold is thus completed. The stationary fingers 274 maintain the fold together as the bucket passes out of the station and on to the longitudinal wrapper sealing station 30, FIG. 1.

The next sheet in the next bucket is then folded in exactly the same manner as described above. The motion period ends after the second wrapper is folded and the movable carriage is retracted for the second time. The carriage stops at the end of the motion period with its pawl 270 urged against the bucket shaft of the next-to-be-processed bucket.

It should be noted that the stationary and movable fingers fold each sheet of wrapping material in turn as the buckets pass through this station. The apparatus comprising this station only operates during periods of motion. During any motion period two buckets pass through this station and the two sheets therein are sequentially folded. Referring to FIG. 1 it should be noted that the folding operation is performed on the bucket already at the folding station 28 and the bucket illustrated as present below the second weigher 27'. While these buckets are being processed, the bucket below the first weigher 27 is advanced. At the end of the motion period this bucket from the first weigher is at the folding station 28 with a sheet waiting to be folded at the start of the next motion period.

LONGITUDINAL SEALING STATION

After leaving the longitudinal wrapper folding station 28, the buckets pass on to the longitudinal wrapper sealing station 30, FIG. 1. At this station two longitudinal heating units seal the longitudinal folds made in the packages at the previous station. The heating units operate together and two packages are sealed simultaneously during each pause period.

Referring to FIGS. 15, 16 the longitudinal sealing station 30 includes a wrapper hold down assembly which maintains the leading and trailing margins of each sheet of wrapping material in a folded position as the bucket is advanced from the wrapper folding station 28, FIG. 1. The wrapper hold down assembly includes three parallel, hold down ribbons 276, 276' and 276'' which extend between the heating units parallel to the longitudinal axis of the machine. These ribbons are fabricated from a thin, flexible, non-metallic material such as Teflon. In the embodiment actually constructed the ribbons were Teflon strips having the thickness of four thousandths of an inch. The ribbons are tensioned by five springs 277 which are connected between the free ends of each ribbon and a supporting rod 278 located on each sealing unit 30. In place of a sixth spring the central hold down ribbon 276' is terminated at the central stationary finger 274'. The ribbons pass around and are guided by pulleys 279 which are supported on rods 280. The pulleys 279 and the two rods 278, 280 are attached to the frame of the machine and are stationary. The three ribbons 276, 276' and 276'' are spaced apart so that they can pass through the three openings 217, 218, 219 in the front and rear walls of the buckets. Between the two sealers 30, 30' the ribbons are held down by three small weights 281, 281',281''.

The longitudinal sealing station 30 further includes two wrapper sealing assemblies 31, 31'. Since each sealing assembly is constructed and operated in the same manner, only the first sealing assembly 31 will be described. Each wrapper sealing assembly includes a movable heating unit 283 that is electrically powered and thermostatically controlled. Each unit is energized to provide an elongated heating surface of constant temperature that is brought into direct contact with the wrapping material. Each heating unit is covered by a thin layer of Teflon that is ten thousandths of an inch thick. The heating unit 283 is supported on a movable supporting frame 284 which permits the heater to move vertically with respect to the frame of the machine. Also attached to the heater supporting frame 284 by vertical rods 286 are two horizontally disposed ribbon depressing rods 288. As illustrated in FIG. 6B, the ribbon depressing rods 288 force the ribbons 276 downward across the top of the packages when the movable heating unit 283 is lowered. When the heating unit is raised, the ribbon depressing rods move up and out of contact with the ribbons 276.

It should be appreciated that the hold down ribbons 267 are constructed from a material that permits the movable heating unit 283 to transmit sufficient heat through the ribbons to join the underlying folded wrapper margins together. Thus, when the movable heating unit 283 is lowered, the heating unit makes an unbroken and continuous seal longitudinally along the entire package. Sufficient heat is transferred through the ribbons 276 so that the underlying folded wrapper is jointed together in one heating operation.

The vertical motion of each longitudinal sealing assembly 31, 31', FIGS. 15, 16 is controlled by the motion of the longitudinal sealing station drive shaft 90. Referring to FIGS. 1, 16 rotation of shaft 90 turns a cam 290 that engages a roller 291. The motion of the roller 291 causes arcuate motion of an arm 292 which turns a torque shaft 294, FIG. 16. Attached to the torque shaft 294 is a gear 296 which intermeshes with a similar gear 297 which turns a comparable torque shaft 295. Thus, the motion of the drive shaft 90 causes timed rotation of the two torque shafts 294, 295.

Referring to FIG. 15, there is a lifting arm 302 attached to each end of the torque shafts 294, 295. There are four lifting arms on the machine. Each lifting arm 302 is connected by a bolt 304 to a lifting link 305. Each lifting link engages and supports one end of the bottom of one of the heater supporting frames 284. Each heater supporting frame 284 slides in two vertical channels 307, FIG. 16 which are rigidly attached to the frame of the machine. These channels also support the stationary components of the wrapper hold down assembly including the rods 278, springs 277, pulleys 279 and rods 280.

The operation of the longitudinal wrapper sealing station 30, can be described by referring to FIGS. 1, 6A, 6B, 15 and 16. After the two buckets leave the longitudinal folding station 28, they come to rest at the end of the motion period beneath one of the longitudinal heating units 31, 31'. The two heating units operate simultaneously and are synchronized by the intermeshing gears 296, 297. These two gears are driven by the shaft 90 and attached cam 290. The two heating units seal two packages during each pause period.

The three hold down ribbons 276, 276', 276'' maintain the wrapper in the folded state in which it left the longitudinal wrapper folding station. Each folded package is passed under the ribbons and the weights 281, 281', 281'' on the ribbons hold the overlapping margins of the wrapper together. The central hold down ribbon 276' is connected to the central stationary finger 274' so that there is no gap or interruption in the pressure applied to the fold.

During the pause period the movable heating units 283 vertically descend along with the ribbon depressing rods 288. The depressing rods descend to a position on either side of each bucket and press the ribbons down over the top of the product. This not only pushes the folded wrapper together, but also forms the package prior to sealing. The heating unit contacts the overlying margins of the wrapper and seals them together in one continuous seal. The longitudinal seal is made in one stroke and sufficient heat is passed through each hold down ribbon 276 to join the underlying portions of the wrapper together.

The heating units 283 are raised and lowered by the motion of the lifting arms 302 which are turned by the shafts 294, 295, FIG. 15. Each heating unit is mounted on the support frame 284. The support frame is downwardly urged on to the lifting arms 302 by the force of gravity. The vertical motion of the support frame is guided by the two vertical channels 307, FIG. 16.

After the longitudinal heat seal has been made, the movable heating unit 283 is raised and the ribbon depressing rods 288 are lifted up out of engagement with the ribbons 276. At this point the pause period ends. Thereafter, during the next motion period the two buckets carrying the two newly sealed packages advance from the longitudinal sealing station and pass onto the wrapper end folding and sealing station 32, FIG. 1.

It should be noted that the apparatus comprising this station only operates during periods of pause. During any one pause period two packages are sealed substantially simultaneously. Referring to FIG. 1, the two buckets operated upon during any pause period are those buckets that were previously located at the second weigher 27' and the longitudinal wrapper folding station 28. In other words, during a motion period the bucket located at the folding station 28 moves to the second sealing assembly 31' and the bucket located at the second weigher 27' moves to the first sealing assembly 31.

WRAPPER END FOLDING AND SEALING STATION

Referring to FIG. 1, after two of the packages have been sealed along their entire length at the longitudinal wrapper sealing station 30, the two packages then proceed to the wrapper end folding and sealing station 32 during the next period of motion. Each package has the shape of an open ended tube. At this station the wrapping machine simultaneously folds the ends of the two packages to overlie the product and seals the wrappers in that position. This folding and sealing operation is performed on two packages during each pause period.

The operation of this station on one of the two packages is illustrated in FIGS. 7, 8A–8F. Briefly, the side folding fingers 326 fold in the four sides of the two packages as shown in FIG. 8B. While the side folding fingers 326 are still in position, the four top folders 332, FIG. 8C descend and sweep the top flaps 328 of the two packages down over the previously folded sides. The side folding fingers are then withdrawn and a jet of air from an air pipe 333 blows the four bottom flaps 329 of the packages upward as shown in FIG. 8D. Thereafter four heating units 335 are moved inward toward the packages, FIG. 8E. The four top folders 328 are then retracted, FIG. 8F, and the heating units 335 are withdrawn. At this point the pause period ends. During the next motion period the completely wrapped and sealed packages are moved out of the station by the main chain.

For brevity only the apparatus operating on one end of one package is described in detail below. The apparatus operating at the other end of the same package and on the other adjacent package is identical in both operation and construction and therefore its description is not repeated.

Figure 18:
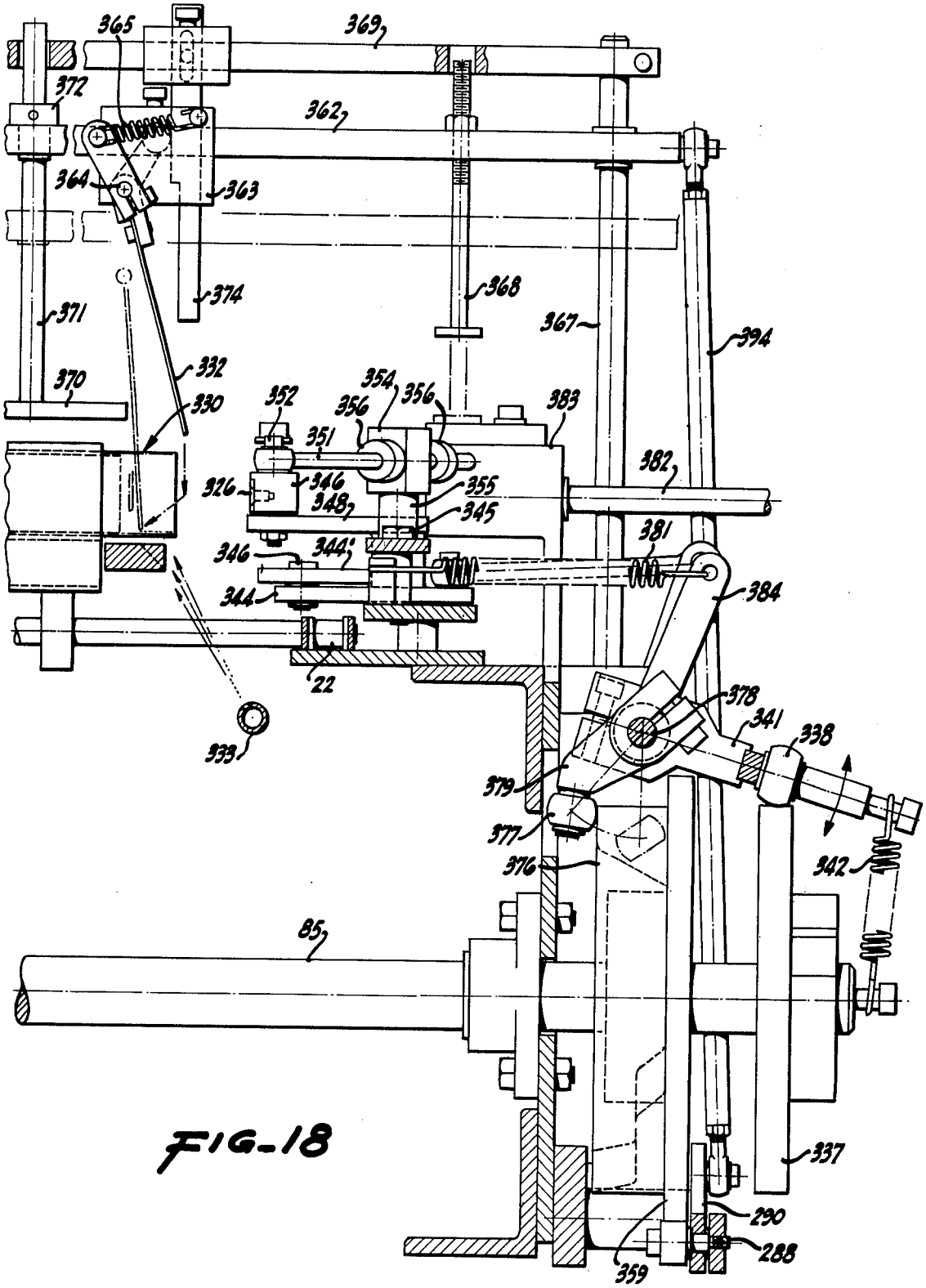
FIG. 18 is an end elevational view, in cross section, of the wrapper end folding and sealing station of FIG. 17. This cross sectional view is taken along line 18—18 of FIG. 17.
Figures 20, 21:
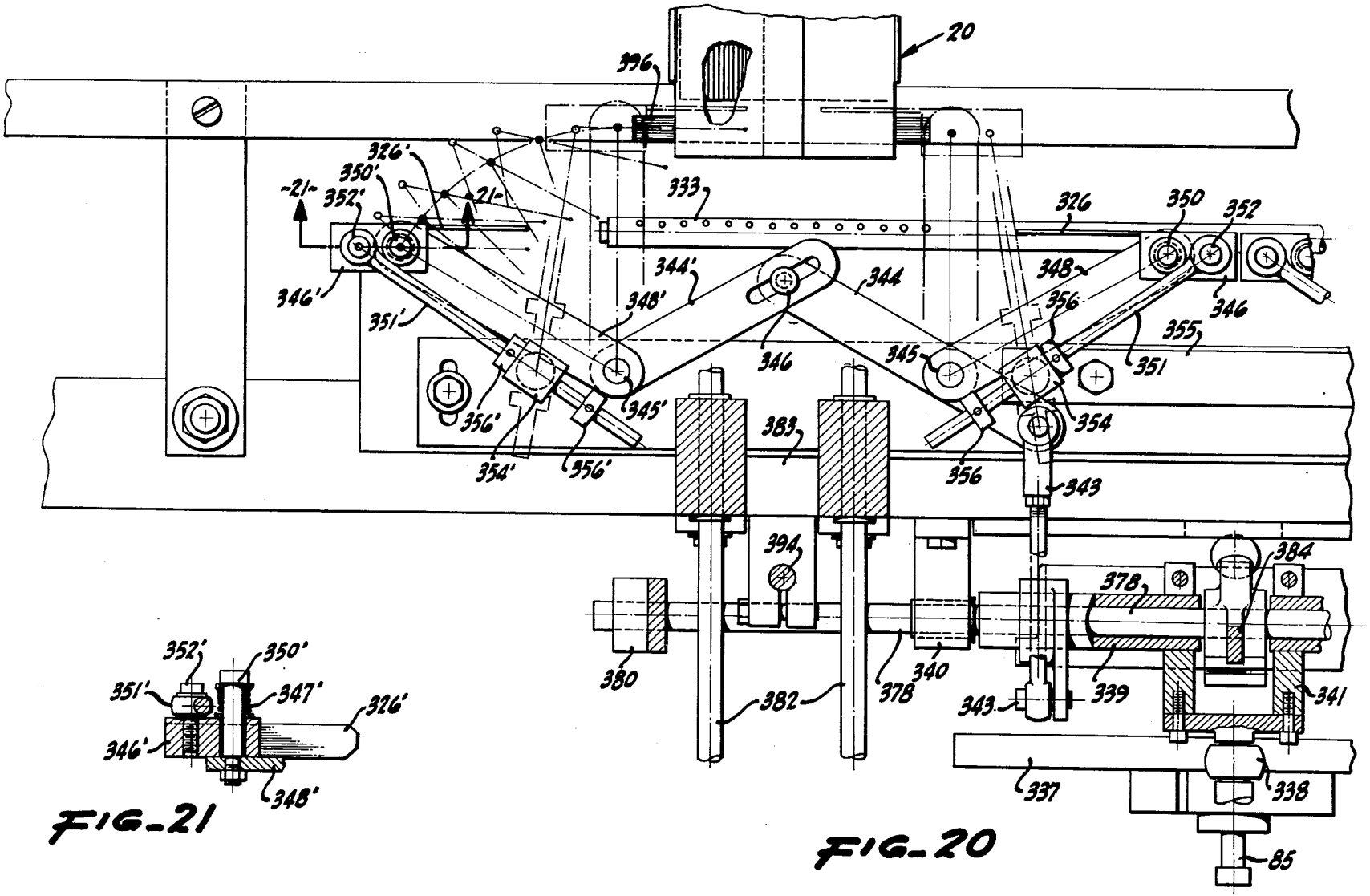
FIG. 20 is a plan view, partially cut away, of the wrapper end folding and sealing station of FIG. 1.
FIG. 21 is a side elevation, in cross section, of a side folding finger of the wrapper folding and sealing station of FIG. 20. This cross sectional view is taken along line 21—21 of FIG. 20.

More particularly the side folding fingers 326, FIGS. 18, 20 are manipulated and controlled by a first cam 337. The first cam is rotated by the end folding and sealing station drive shaft 85, FIG. 9. This drive shaft is continuously turned by a chain 84 connected to main torque shaft 80 as described in the section entitled "The Power Train." The surface of the first cam 337 is engaged by a roller 338 which is vertically driven along an arcuate path about a hollow the shaft 339, FIG. 20. The roller 338 is urged against the cam 337 by a spring 342. The hollow shaft 339 is in two parts which are connected to the axle of the roller 338 by a yoke 341. The yoke provides means whereby an inner shaft 278 can engage a third cam 376 hereinafter described. The hollow outer shaft 339 is coaxial with the inner shaft 378 and each turns independently of the other. The hollow shaft is supported by the inner shaft which is in turn supported by two journal bearings 340 that are mounted to the frame of the machine. The hollow shaft 339 is connected by a linkage 343 to an arm 344, FIG. 20. Rotation of the hollow shaft 339 by the first cam 337 causes pivotal rotation of the arm 344 in a horizontal plane about the vertical shaft 345. The arm 344 is rigidly connected to a finger arm 348 so that rotation of the arm 344 about shaft 345 causes corresponding rotation of the finger arm 348 about the same shaft. The arm 344 is also connected by a pin 346 to a comparable arm 344'. The pin 346 is permitted to travel within an elongated slot located in arm 344'. The comparable arm 344' causes arcuate motion of a second finger arm 348' about the vertical shaft 345'. The above described linkage is interconnected so that any motion of the hollow shaft 339 causes uniform, opposing, horizontal motion of the two finger arms 348, 348'.

Each side folding finger 326, 326' is fabricated from a piece of thin steel stock. The two fingers are each mounted on a support member 346, 346' that is rotatably mounted to the end of the finger arm 348 by a shaft 350. The free ends of the fingers are pointed inward, toward each other and generally lie on a plane parallel with the direction of motion of the buckets. The orientation of each finger is maintained by a guide rod 351. The guide rod is attached to the remote end of each support member 346 by a shaft 352. The guide rod freely slides in a bore drilled in a rotatable guide 354. The guide 354 is rotatably mounted on a stationary support 355 which is rigidly attached to the frame of the machine. The guide rod 351 is permitted to freely turn about the rotatable guide 354 and freely slide along its longitudinal axis between the stops 356. Thus, a lost motion linkage is formed. Neither the guide rod 351 nor the rotatable guide 354 is driven directly by the cam 337. Each moves only in response to the motion of the support member 346. The orientation of each finger is further maintained by a small friction spring 347, FIG. 21 mounted on shaft 350. The spring urges the support member 346 against the finger arm 348 and provides a drag.

In operation, the insertion and retraction of the side folding fingers 326', FIG. 18, 20, 21 is controlled by the first cam 337 mounted on shaft 85. Shaft 85 continuously turns and makes one full revolution during a pause and motion period. The rotation of the first cam 337 causes vertical arcuate motion of the roller 338 such that the outer hollow shaft 339 is turned about the longitudinal axis of the machine. The rotation of this shaft is translated through linkage 343 to cause corresponding rotation of arm 344 about shaft 345. In particular, upward motion of the roller 338 causes counterclockwise rotation of the arm 344 about the shaft 345 as illustrated in FIG. 20. Counterclockwise rotation of arm 344 in turn causes counterclockwise rotation of finger arm 348. The arm 344 is also connected by a pin 346 to arm 344' so that counterclockwise rotation of the finger arm 348 is matched by clockwise rotation of the finger arm 348'. Thus, upward motion of the roller 338 swings the two finger arms together.

When the finger arms 348, 348' swing together, the side folding fingers 326, 326' travel along the path illustrated in FIG. 20. The orientation and path of the fingers is generated by the radial and pivotal motion of the guide rod 351 about the rotatable guide 354. The guide rod moves between the stops 356 of the lost motion linkage. As the fingers swing together, the end of the package is folded over as illustrated in FIGS. 8A, 8B. The fingers come to rest with their free ends almost touching and with their sides abuting against the product.

The side folding fingers 326 are withdrawn by the clockwise rotation of finger arm 348 and the counterclockwise rotation of finger arm 348' as illustrated in FIG. 20. The finger arms are turned in this manner by the outward motion of the linkage 343 which is brought about by the downward motion of the roller 338 and the clockwise rotation (FIG. 18) of the hollow shaft 339.

Figure 17:
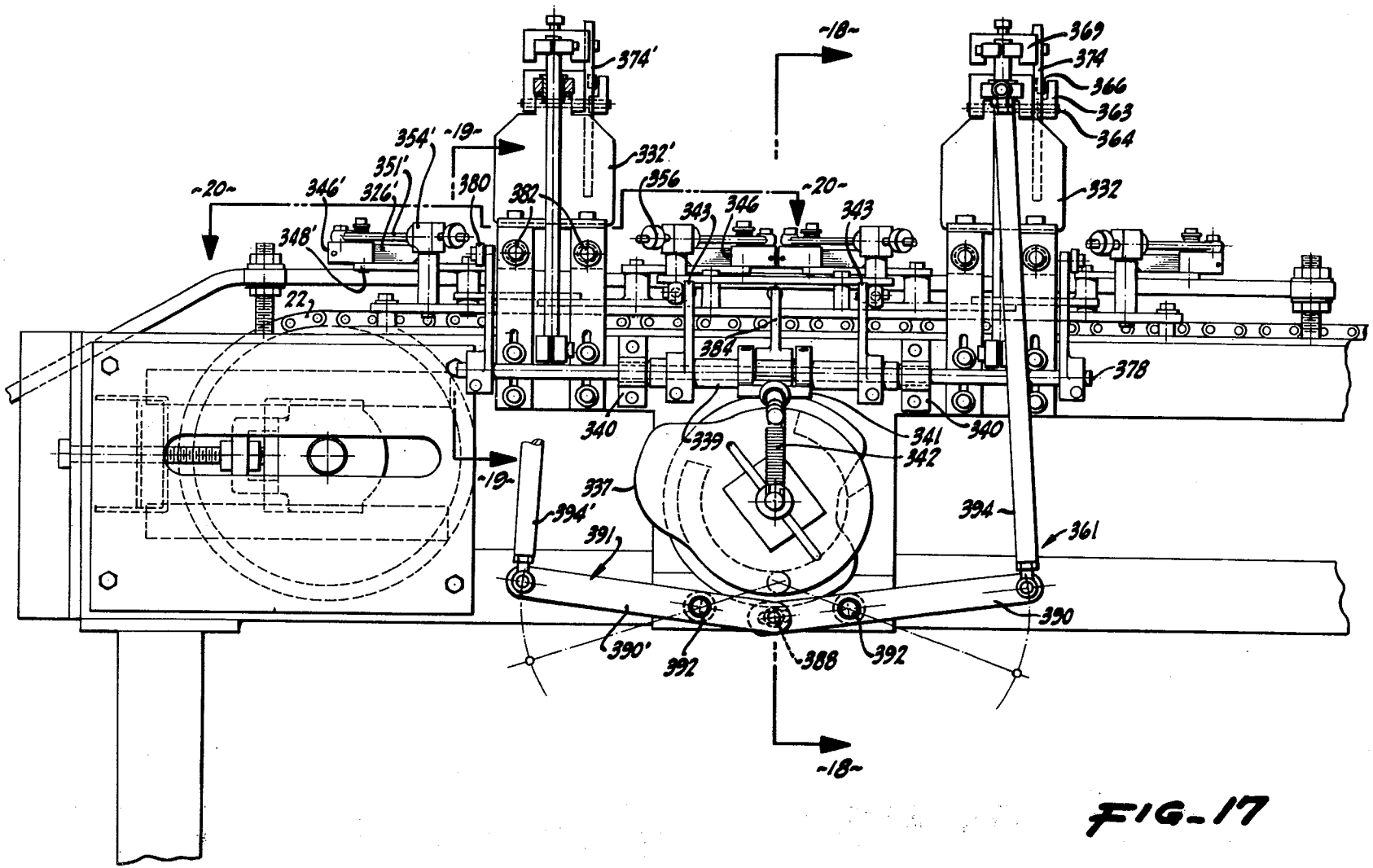
FIG. 17 is a side elevational view, partially cut away, of the wrapper end folding and sealing station of the machine of FIG. 1.

After the side folding fingers 326 have come together, FIG. 8B, the end of the package has a top flap 328 and a bottom flap 329 that extend beyond the fingers. The top flap 328 on each package is folded down by a top folder 332. Referring to FIGS. 17, 18, the motion of the top folder 332 is controlled by a second cam 359 also mounted on the end folding and sealing station drive shaft 85. Both the second cam 359 and the first cam 337 rotate together on this drive shaft. The second cam 359 operates through a linkage 361 to control the vertical motion of a horizontal support arm 362. The second cam causes vertical motion of pin 388 which rotates arms 390 about the stationary shaft 392.

This in turn causes vertical motion of the vertical arm 394.

Each top folder 332 is connected to the horizontal support arm 362 by a shaft 364 located on a mounting member 363. The shaft 364 permits the top folder to move laterally with respect to the package. The pivotal motion of the top folder 332 about shaft 364 is controlled by a cam 374, FIG. 17 which is engaged by a roller 366. The top folder 332 is urged against both this cam and the package by a spring 365. The cam moves the top folder so that the top flap of the package is closed in a sweeping motion as illustrated in FIG. 18.

The vertical motion of the horizontal support arm 362, FIG. 18 is restricted by a stationary guide rod 367. The guide rod and its attached horizontal supporting frame 369 are rigidly mounted to the frame of the machine. The guide rod 367 maintains the alignment of the horizontal support arm 362 with respect to the package 330. The downward motion of the horizontal support arm 362 is arrested by a stop 368 that is attached to the support arm.

During the end folding and sealing operation, FIGS. 8C–8F each package of product is flattened in its bucket by a package pressing plate 370. Referring to FIG. 18, the package pressing plate is carried on the horizontal support arm 362 and guided therewith by a plurality rods 371 only one of which is shown in FIG. 18. The downward motion of the pressing plate is arrested by the stops 372 which also permit the plate to be raised by the support arm 362. The plate presses down on the package of product with just the force of its own weight. The pressing plate is raised and lowered by the motion of the horizontal support arm 362.

In operation, the top folder 332, FIG. 17 is lowered down on to the package by the downward motion of the linkage 361. More specifically, the second cam 359, FIG. 18 causes the pin 388, FIG. 17 to move upward and to rotate arms 390 about the stationary shaft 392. The remote ends of arms 390 move downward the thereby lower the vertical arms 394. Referring to FIG. 18, the downward motion of the vertical arms 394 (only one of which is shown in this view) lowers the horizontal support arm 362. Since the mounting member 363 and the shaft 364 are mounted on the support arm, the top folder 332 is likewise lowered.

The top folder 332 bends the top flap of the package shut in a sweeping motion illustrated in FIG. 18. This sweeping motion is generated by the engagement of the cam 374 with a cam follower 366 attached to the top folder. The cam 374 is attached to the horizontal support frame 369 and is stationary. The cam follower controls the rotation of the top folder about the shaft 364 and is urged against the cam 374 by the spring 365.

The downward motion of the horizontal support arm 362, FIG. 18 also lowers the package pressing plate 370. When the pressing plate comes to rest against the package, the horizontal support arm passes below the stops 372 and the full weight of the pressing plate is exerted on the package.

The top folder is raised by the upward motion of the horizontal support arm 362, FIG. 18 which in turn is caused by the upward motion of the vertical rods 394. The package pressing plate 370 is also raised by the horizontal support arm 362 which engages the stops 372, FIG. 18 on the supporting rods 371. The vertical rods are raised by the second cam 359 which moves pin 388, FIG. 17 downward.

The lower flap of the package is blown upward around the outside edge of the top folder by a jet of air as illustrated in FIG. 8D. Because the wrapping material is quite flexible, the bottom flap is blown to a substantially vertical position. Referring to FIGS. 18, 20 the jet of air originates from an air pipe 333 which is located below and parallel with the upper run of the main chain 22. The production of air is mechanically sequenced by a cam located on shaft 80, FIG. 9. This cam actuates a mechanical air valve 375. In order to provide an unobstructed path for the air, the frame of the machine directly below the package at point 396 has been relieved.

Figure 19:
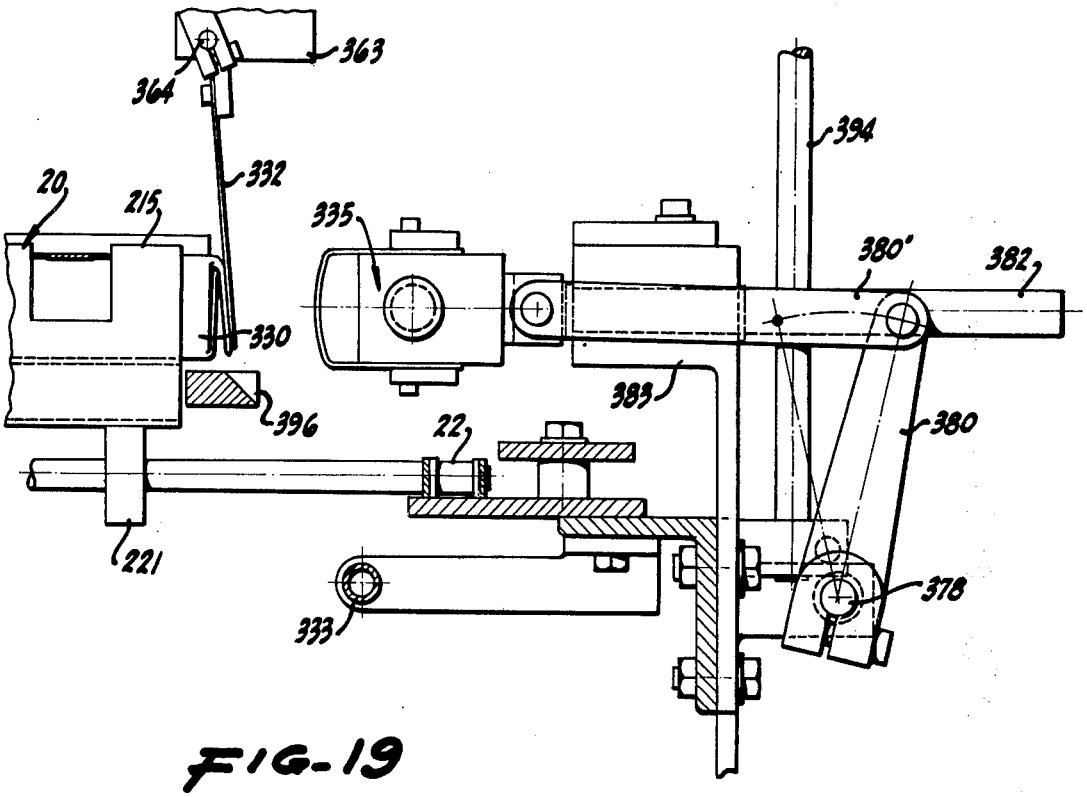
FIG. 19 is an end elevational view, in cross section, of the wrapper end folding and sealing station of FIG. 17. This cross sectional view is taken along line 19—19 of FIG. 17.

While the air pipe 333, FIG. 8D is blowing up the bottom flap 329, a heating unit 335 commences to move in and seal the end of the package. Referring to FIGS. 18 and 19 the heating unit 335 is pressed against and withdrawn from the package under the action of a third cam 376. The third cam is formed on the inside, circular surface of the second cam 359. The third cam rotates in a continuous manner with the other cams 359, 337 on shaft 85. The third cam rotates the inner shaft 378, FIG. 20 through roller 377 and roller arm 379 which is attached to the shaft. The roller 377 is urged against the third cam by a tension spring 381 which applies a torque through arm 384 to the inner shaft 378. The inner shaft is coaxial to and located inside of the hollow shaft 339 hereinbefore described. The roller 377 and roller arm 379 are located within the yoke 341, FIG. 20, joining the ends of the hollow shaft together. The inner shaft 378 is supported by the journal bearings 340 and rotates independently of the hollow shaft 339.

Rotational motion of the inner rod 378 is translated into horizontal motion of the heating unit 335 by a linkage 380. Counterclockwise rotation of the inner shaft 378 as illustrated in FIG. 19 causes the heating unit to move in toward the package and clockwise rotation of the shaft causes the heating unit to move out and away from the package. Attached to the rear or each heating unit 335 are two parallel, horizontal guide rods 382. These guide rods are received in two bores located in a stationary bracket 383. The stationary bracket is rigidly attached to the frame of the machine. The guide rods permit lateral displacement of the heating unit while providing alignment of the unit with respect to the package.

The heating unit 335 is a conventional electrical resistance type heating unit. The surface temperature of the heating unit is controlled through a temperature regulating relay TR1, FIG. 22. This relay regulates the current to the heating elements so that a predetermined surface temperature is continually maintained.

In operation, the heating unit 335 FIG. 8E is brought in toward the package 330 by the third cam 376 FIG. 18. This cam moves the roller 377 and the roller arm 379 in counterclockwise direction as illustrated in FIG. 18. The roller arm turns the inner shaft 378 and the inner shaft 378 in turn pushes the heating unit through linkage 380 toward the package. The heating unit is guided by the two guide rods 382 which are supported and aligned in the bracket 383.

Figure 24:
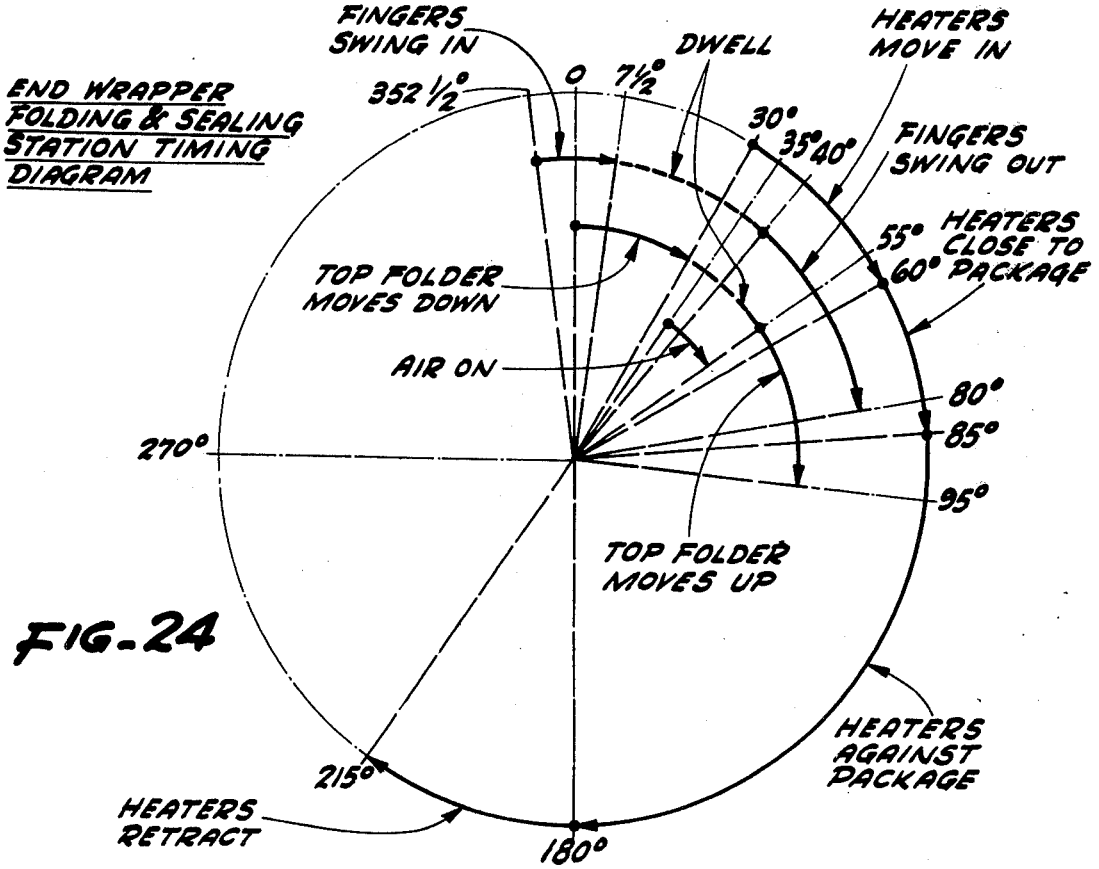
FIG. 24 is a timing diagram of the end wrapper folding and sealing station.

The combined sequence of all of the operating components of the end wrapper folding and sealing station can be best explained with the timing diagram of FIG. 24 and the sequence of FIGS. in FIGS. 8A–8F. The 0° point on the diagram corresponds to the point in time when the two buckets have come to rest at the station and a pause period begins. The side folding fingers 326 commenced to swing into place 7½° before the main chain came to a stop. FIG. 8A illustrates the fingers in motion. At 0° the top folder begins to descend and at +7½° the side folding fingers are in place abutting against each package. This is illustrated in FIG. 8B. The top folder 332 and the package pressing plate 370 have fully descended by 30° and the top folder has folded over the top flap 238 as shown in FIG. 8C. The air jet 333 comes on at 35° and the side folding fingers begin to retract from behind the top folder 332 at 40°. This is illustrated in FIG. 8D. Also at 30° the heating units 335 begin to move in toward the packages, FIG. 8E. The air jet is removed at 55° and the top folder 332 begins to be raised, FIG. 8F. The heaters are within one eight of an inch of the package by 60°. By 80° the side folding fingers 326 are fully retracted to their initial position. The heaters 335 begin to press against the package and heat seal the ends at 85°. By 95° the top folder 332 and the package pressing plate 370 are fully retracted. At 180° the heat seal has been made and the heaters begin to retract. At 215° the heaters are fully withdrawn and out of the way.

The end of the pause period occurs at 360°. At that time the heating unit 335 is withdrawn to its most outward position. The side folding fingers 326 have been rotated out of the way of the buckets and back to the initial position illustrated in FIG. 20. In addition, the top folder 332 is raised to its most upward position along with the package pressing plate 370 as illustrated in FIG. 18. When the next period of motion begins, the main chain 22 moves the two newly sealed packages out of the end folding and sealing station and onto a conveyor belt (not shown) where the packages are carried to a convenient location for boxing.

ELECTRICAL SYSTEM

Referring to FIGS. 9 and 22 the wrapping machine is driven by a conventional DC motor 36. The speed of the wrapping machine is controlled by a rheostat 502 that is connected in series with the DC motor. The first and second weighers 27, 27' are energized by microswitches MS1, MS2. These microswitches are actuated by two cams mounted on the output shaft 102 of the solonoid operated clutch 96. This clutch in turn is controlled by the microswitch MS4 that is actuated by a cam mounted on the output shaft 75 of the speed reducing gear box 38.

The longitudinal and end sealing heating units 283, 335 are temperature regulated by the relays TR1, and TR2. Each unit is energized to provide a heating surface of constant temperature. When the surface temperature of one of these heating units rises above the predetermined limit, the corresponding temperature relay opens a contact in the line to the heater and de-energizes the unit.

The light 504 is the light directed upon the photoelectric cell 195, FIG. 11 that controls the feed of wrapping material at the wrapper feed and cutting station 24. The photoelectric cell actuates the photoelectric relay P/E R. The photoelectric relay is energized by a microswitch MS7 which is actuated by a cam attached to shaft 56, FIG. 9. The paper feed clutch 192 and the paper feed brake 193 are alternately energized by a microswitch MS6 which is actuated by a cam mounted on the shaft 64. During a motion period microswitch MS6 operates to either permit motion of the wrapper feed rollers 176, 180 or to stop such motion. The operation of microswitch MS6 is overriden by the photoelectric relay P/E R in order to provide registration of the printed spots on each sheet. When the microswitch MS6 is in the position illustrated in FIG. 22 and microswitch MS7 is closed to energize the photoelectric relay P/E R, the leading edge of the next spot triggers the photocell. The photocell actuates the photoelectric relay and it in turn closes photoelectric relay contact P/E R1 and opens photoelectric relay contact P/E R2. This energizes the paper feed brake 193 and de-energizes the paper feed clutch 192. Soon thereafter microswitch MS6 is shifted to energize the brake 193 and then microswitch MS7 is opened to de-energize the photoelectric relay P/E R. Contacts P/E R1 and P/E R2 shift back to the positions illustrated in FIG. 22 and microswitch MS6 regains control of the feed of wrapping material.

The knifed 208, FIG. 11, at the wrapper feed and cutting station is actuated by microswitch MS5 which is controlled by a cam located on the output shaft 75 of the speed reducing gear box 38, FIG. 9. The movable carriage 261, FIG. 15, which translates the longitudinal folding fingers 255 back and forth is controlled by microswitch MS8. Microswitch MS8 is actuated by a cam located on the output shaft 75 of the speed reducing gear box 38, FIG. 9. The movement of microswitch MS8 causes the operating arm 263, FIG. 15, of the pneumatic cylinder 265 to either extend or retract.

Side Folding Fingers - Alternative Embodiment

FIGS. 25–29 illustrate an alternative embodiment of the side folding fingers which are used in the wrapper end folding and sealing station 32, FIG. 1. These side folding fingers and the associated linkage as described below permit the finger assemblies to operate closer together and the spacing between the buckets to be narrowed. This embodiment also incorporates a less complex actuating linkage.

When the side folding fingers illustrated in FIGS. 25–29 are incorporated into the wrapper end folding and sealing station, the station performs the same functions as described above and illustrated in FIGS. **7, 8*a*–8*c*. That is to say, the finger assemblies simultaneously fold and seal the ends of two packages during each pause period. The heaters 335, FIG. 28, and associated actuating linkages 376–380; the top folders 322 and associated actuating linkages 362, 365, 364, 374; and the air pipe 333 are constructed and operate in the same manner as described below. The timing diagram, FIG. 24**, for the wrapper end folding and sealing station is likewise unchanged.

Figure 27:
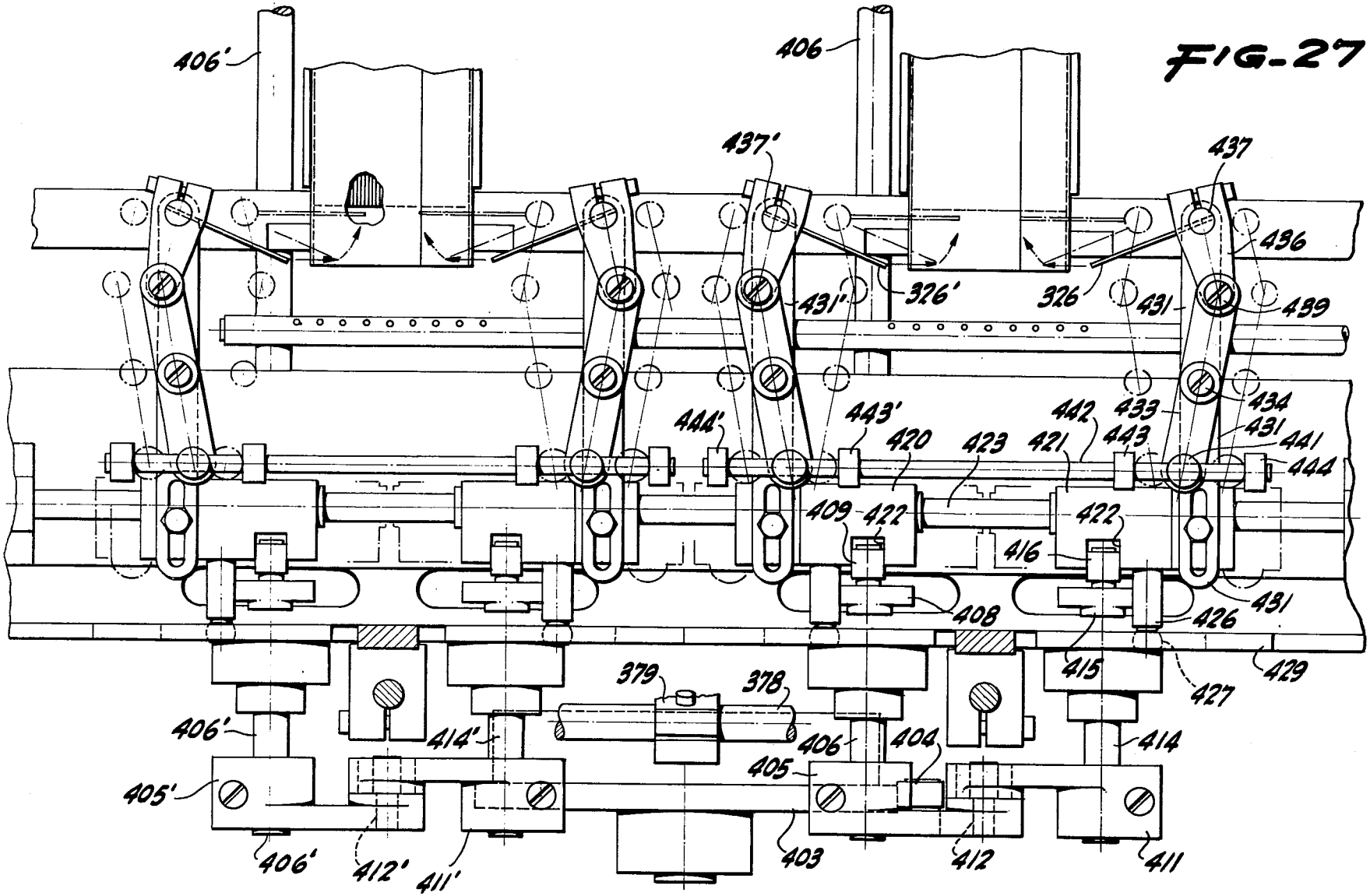
FIG. 27 is a plan view, partially cut away, of the alternative embodiment of the wrapper end folding and sealing station of FIG. 25.
Figures 28, 29:
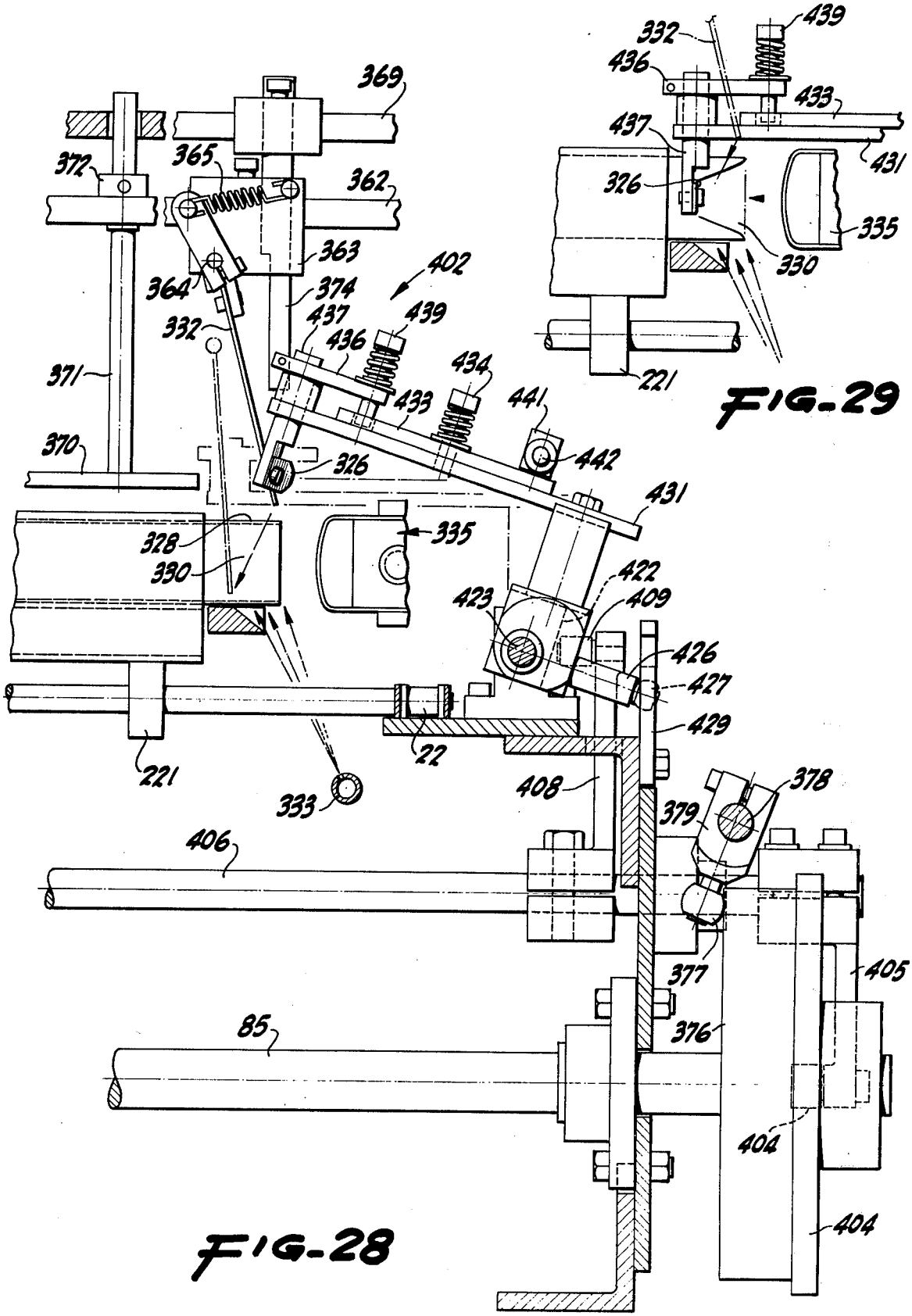
FIG. 28 is an end elevational view, in cross section, of the alternative embodiment of the wrapper end folding and sealing station of FIG. 25. This cross sectional view is taken along line 28—28 of FIG. 25.
FIG. 29 is an end elevational view, in cross section and partially cut away, of the wrapper end folding and sealing station of FIG. 28. This view illustrates the fingers in the horizontal position.

Briefly, each finger assembly 402, FIG. 28, remains in an elevated position as illustrated in FIG. 28 between folding operations. The fingers 326 are elevated above the packages 330 in order to permit the packages to enter the station without mechanical interference during each motion period. During the subsequent pause period the fingers 326 pivot downward to the horizontal as illustrated in FIG. 29. Referring to FIG. 27, the two opposing fingers 326, 326' thereafter come together while simultaneously sweeping the side margins of the wrapper over the end of the product. The fingers initially engage the wrapper at an angle which is inclined with respect to the plane of the end of the product. The fingers then sweep around and come to rest tip to tip and in a plane co-planar with the end of the product. After the top folder 332, FIG. 28, descends and sweeps the top flaps 238 of the package over the previously folded side margins, the side folding fingers are withdrawn in a reverse manner and returned to the elevated position illustrated in FIG. 28.

For brevity only the apparatus operating on one end of one package is described in detail below. The apparatus operating at the other end of the same package and on the other adjacent package is identical in both operation and construction.

Figures 25, 26:
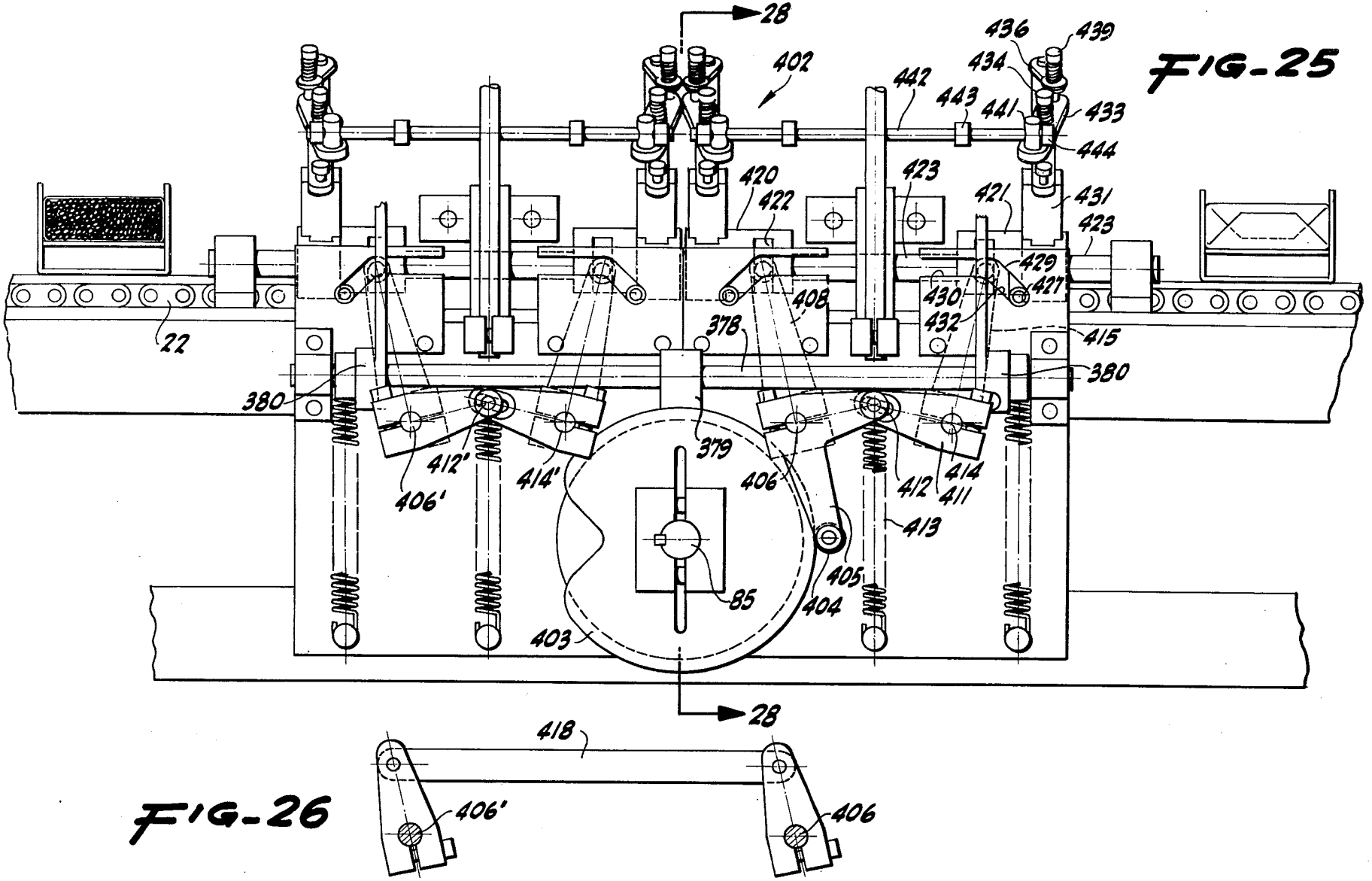
FIG. 25 is a side elevational view partially cut away, of an alternative embodiment of the wrapper end folding and sealing station.
FIG. 26 is a side elevational view of the linkage for driving the side folding fingers of the wrapper end folding and sealing station.

More particularly, the finger assemblies 402, FIG. 25, are manipulated and controlled by a cam 403. This cam is rotated by the end folding and sealing station drive shaft 85, FIG. 9. This drive shaft is continuously turned by a chain 84 connected to the main torque shaft 80, as described in the section entitled "The Power Train." The surface of this cam is engaged by a roller 404 that is attached to a bell crank 405. The bell crank 405 is urged against the cam 403 by a spring 413 which is anchored to the frame of the machine. This bell crank is rigidly attached to a horizontal shaft 406 which is journaled to the frame of the machine and is rotated by the engagement of the roller with the cam 403. Referring to FIG. 28, the shaft 406 has an arm 408 which is rigidly mounted thereto and which carries a roller 409. The bell crank 405 also actuates an arm 411 through a pin 412. The arm 411 is rigidly attached to a short shaft 414 that is journaled to the frame of the machine. Referring to FIG. 27, the shaft 414 rotates an arm 415 that terminates in a roller 416. The two arms 408, 415 cause the fingers 326, 326' to move together, i.e. tip to tip, as described below.

Referring to FIGS. 25–27, the station includes four sets of finger assemblies 402 of which two are illustrated. The four sets of finger assemblies are actuated by the cam 403, FIG. 25, and the rotation of the shaft 406. Shaft 406, FIG. 27, extends across the frame of the machine and is journaled to a side plate on the other side (not shown). Shaft 406 is connected to shaft 406', FIG. 25, by a pinned link 418, FIG. 26. Thus, the two shafts 406, 406' rotate together and the shafts 414, 414' have a complementary rotation.

Referring to FIG. 27, the rollers 409, 416 on the end of the arms 408, 415 each engage a sleeve 420, 421. These sleeves are generally cylindrical in shape and are slidably received on a stationary horizontal rod 423. This rod is rigidly attached to the frame of the machine, is aligned in parallel with the path of buckets, and guides the motion of the sleeves. The two sleeves slide along the rod as illustrated in FIG. 27, and rotate about the rod to elevate the finger assemblies 402 above the packages as illustrated in FIG. 28. The rollers 409, 416 are each received in a rectangular slot 422 in the sleeves. The rear wall of each slot is parallel with the plane of the fingers 326. The arcuate motion of the arms 408, 415 and their associated rollers cause the sleeves to slide together and apart along the axis of the rod.

Mounted on each sleeve 420, 421, FIG. 27, is a short rod 426 that terminates in a roller 427. The longitudinal axis of this rod is perpendicular to the rear wall of the slot 422. The roller 427 at the end of the rod engages a cam surface 429, FIG. 25. This cam surface is formed in a plate that is rigidly attached to the frame of the machine. The cam surface has a generally horizontal portion 430 that connects with an inclined portion 432. The inclined portion of the cam surface causes the rotation of the sleeves about the rod 423 as the sleeves slide back and forth on the rod. When the roller 427 is at the bottom of the inclined portion of the cam surface as illustrated in FIG. 25, the finger assemblies 402 are in the elevated position. When the roller is moved to the horizontal portion 430 of the cam surface, the finger assemblies have been lowered to the horizontal position and are in the process folding the wrapping material over the end of the spaghetti.

A rigid support arm 431, FIG. 27, is bolted to each sleeve 420, 421. The support arm connects the fingers 426 to the sleeves. Pivotally mounted to the support arm is a guided arm 433 that is connected to the support arm by a pin 434. The support arm also is pivotally attached to a finger arm 436. This finger arm is connected by a rotatable shaft 437 to the fingers 326. The fingers are rotated about the shaft 437 by the motion of the finger arm 436. The finger arm is connected to the guide arm 433 by a pin 439 and moves conjointly with it.

The guide arm 433, FIGS. 25, 27, carries a finger actuator 441 that is mounted on the end nearest the sleeves 420, 421. The finger actuator is a rod pivotally mounted to the guide arm and has a lateral bore through its center. The lateral bore slidably receives a guide rod 442 and the actuator moves between an inner collar 443 and an outer collar 444. The collars are rigidly attached to the guide rod. The guide rod and the finger actuators cause the fingers 326, 326' to swing about the shafts 437 from the position illustrated in FIG. 27 in solid lines to the position illustrated in phantom lines.

Each side folding finger 326, 326' is fabricated from a piece of thin steel stock. The two fingers are each mounted on the shaft 437 which is controlled by the motion of the finger arm 436, FIG. 27. During the folding operation the fingers move from an elevated position above the package 330, FIG. 28, to a horizontal position, FIG. 29. Referring to FIG. 27, the fingers normally are positioned at an angle inclined with respect to the plane of the edge of the package. When the fingers commence folding the wrapper, the fingers swing about the shaft 437 to a tip to tip position co-planar with the plane of the end of the package.

In operation, the finger assemblies 402 normally rest above the buckets in the elevated position illustrated in FIGS. 25,28. This position permits the buckets to move into the station without mechanical interference. In the elevated position the two arms 408, 415 rest with their associated rollers 409, 416 at the most separated position. Thus, the sleeves 420, 421 are separated to the maximum extent and the rollers 427 attached thereto are positioned at the bottom of the inclined portion 432 of the cam surface 429.

After the buckets have entered and stopped at the station and the period of pause commences, the cam 403, FIG. 25, causes the bell crank 405 to rotate about the shaft 406 in a clockwise direction as illustrated in FIG. 25. Thus in turn rotates shaft 406 and the arm 408. The shaft 406 also drives the corresponding shaft 406' through the linkage 418, FIG. 26. The clockwise motion of the bell crank 405 causes a complementary counterclockwise motion of the arm 411, FIG. 25, about the shaft 414.

When the arm 408, FIG. 25, moves clockwise about the shaft 406, the roller 409, FIG. 27, engages the sleeve 420 and causes the sleeve to slide along the rod 423 toward the center of the finger assembly. The motion of the sleeve 420 causes the roller 427 to ride up the cam surface 429 and thereby to rotate the sleeve about the rod. The counterclockwise motion of the arm 411 about the shaft 414 causes the arm 415 to slide the other sleeve 421 along the rod 423 toward the center of the finger assembly. This motion of the sleeve 421 also causes the roller 427 to ride up its cam surface 420 and rotate the sleeve 421 about its guide rod. Thus, the rotation of the cam 403 causes the two sleeves 420, 421 to slide together along the rod 423 and to rotate about the rod in a counterclockwise direction as illustrated in FIG. 28. The counterclockwise rotation of the sleeves causes the finger assemblies 402 to lower to the horizontal position, FIG. 29.

The two sleeves 420, 421, FIG. 27, slide together along the rod 423 until they nearly touch. The support arms 431, 431' are rigidly attached to the sleeves and move the fingers together with a translational motion that is parallel to the axis of the rod 423.

The motion of the right support arm 431 from right to left also moves the finger actuator 441 into engagement with the inner collar 443 on the guide rod 442. Since both sleeves are movingd towards each other, the two finger actuators simultaneously engage the two inner collars 443, 433' and a complementary motion is developed. The engagement of the finger actuator 441 with the inner collar and the continued inward translational movement of the support arm 431 causes a counterclockwise rotation of the guide arm 433 about the pin 434. This counterclockwise motion is translated by the pin 439 into clockwise rotation of the finger arm 436 about the shaft 437. The finger arm in turn rotates shaft 437 and the finger 326. As illustrated in FIG. 27, finger 326 rotates in a clockwise direction about shaft 437 and finger 326' rotates in a counterclockwise direction about shaft 437'.

It should be noted that the fingers 326, 326', FIG. 27, have both an inward translational motion as illustrated in FIG. 8A and a rotational motion as illustrated in FIG. 27. The fingers first engage the side margins of the wrapper at an angle inclined with respect to the plane of the end of the product. As the fingers come closer together, they rotate about the shaft 437. This sweeps the margins over in a predetermined manner and avoids any undesirable folding. The fingers come to rest as illustrated in FIGS. 8B, 27, tip to tip and in a plane that is co-planar with the end of the package.

Next, the top folder 332 descends, FIG. 8C, and the fingers are retracted as illustrated in FIG. 8D. Retraction of the fingers is controlled by the cam 403, FIG. 25, and is basically the reverse of the above-described process of insertion. The two sleeves 420, 421 are slid apart along the rod 423 by the motion of the two rollers of 409, 416, the arms, 408, 415, 411, and the bell crank 405. This motion causes the fingers to separate. The fingers 326, 326' move apart in parallel alignment until the finger actuators 441 engage the outer collars 444. The continued outward motion of the sleeve 421 and the engagement of the actuator 441 with the outer collar 444 cause the guide arm 433 to rotate in a clockwise direction about the pin 434. The finger arm 436 and the finger 326 in turn rotate in a counterclockwise direction about the shaft 437. In a similar manner finger 325' is rotated in a clockwise direction about the shaft 437'.

The rollers 427 travel along the horizontal portion 430 of the cam surface 429 until the rollers engage the inclined portion 432 of the cam surface 429. The sleeves then commence to rotate about the rod 423. The rotation of the sleeves cause the fingers to be elevated back into the starting position illustrated in FIG. 28. The operational cycle of the side folding fingers is thus completed.

It is contemplated within the scope of the present invention to align the two weighers 27, 27', FIG. 1, at the bucket filling station 26 in tandem alignment, one in back of the other. In this position the controls and the timing chains can be located on the same side of the packaging machine.

It is also contemplated that the length of the machine can be varied by changing the spacing of the buckets. If a longer apparatus is desired, the spacing between the buckets and the distances between the stations can be increased. Likewise, if it is desired to shorten the length of the machine, the buckets and the stations can be spaced closer together.

In the preferred embodiment, the two weighers 27, 27', FIG. 1, are described as facing each other and filling two adjacent buckets simultaneoulsy. The buckets can also be filled in various sequences while still running the weighers in duplex. For example, the weigher 27' can be rotated 180° and be positioned to fill buckets spaced three buckets ahead of the bucket simultaneously being filled by the weigher 27.

Further, it is contemplated that the pneumatic actuator 265, FIG. 1, that translates the fingers at the longitudinal wrapper folding station can be replaced by a cam and lever arrangement. In addition, the top folders 332, FIG. 18, and the horizontal plate 370 can be raised and lowered by a pneumatic cylinder instead of the arms 390, 390' and the rods 394, 394', FIG. 17.

Thus, although the best modes contemplated for carrying out the present invention have been herein shown and described, it will be apparent that modifications and variation may be made without departing from what is regarded as the subject matter of the subject invention.

What is claimed is:

1. A machine for wrapping predetermined weights of elongated product in package with sheets of wrapping material, said sheets having both a leading margin and a trailing margin, comprising:

(a) a frame;

(b) endless conveying means carried by the frame and having an upper generally horizontal run, said conveying means including means forming elongated buckets extending laterally of the direction of movement of the conveying means, the buckets being spaced apart in the direction of movement, upwardly faced and having means for retaining the leading margins of the sheets relative to the buckets;

(c) means for cyclically driving the conveying means with periods of pause between periods of advancing movement, said buckets move in tandem, one after the other, through the machine;

(d) means for positioning sheets of wrapping material successively over two buckets moving in tandem during each period of advancing movement, said sheets being held by the sheet retaining means;

(e) dispensing means for depositing substantially simultaneously two predetermined amounts of the product upon the sheets and into two of the buckets during each period of pause of the conveying means; and (f) means operating upon the sheet associated with each bucket for performing wrapping, folding and sealing operations to complete the package.

2. The machine of claim 1 further including means for cutting in succession two sheets of wrapping material of predetermined dimensions from a roll of such material during each period of advancing movement of the conveying means and further including means for successively advancing said sheets over two buckets moving in tandem during each period of advancing movement of the conveyng means so that said two sheets are held relative to the buckets by the sheet retaining means.

3. The machine of claim 1 wherein the wrapping material positioning means includes drive means powered by reciprocating means having two strokes during each period of advancing movement of the conveying means, said drive means converts the two reciprocal strokes into a unifirectional shaft output that drives the wrapping material positioning means.

4. A method for wrapping prdetermined weights of elongated product in packages with sheets of wrapping material, comprising the steps of:

(a) conveying in tandem a plurality of elongated buckets along a generally horizontal run (b) driving cyclically the plurality of buckets with periods of pause between periods of advancing movement;

(c) positioning sheets of wrapping material successively over two buckets moving in tandem during each period of advancing movement;

(d) depositing substantially simultaneously two predetermined amounts of the product upon the sheets and into two of the buckets during each period of pause of the conveying means;

(e) folding the sheet associated with each bucket around the product therein; and (f) heat sealing the folded sheets to form a package.

5. The method of claim 4 further including cutting successively two sheets of wrapping material of predetermined dimensions from a roll of such material and advancing the two sheets successvely during each period advancing movement of the conveying means.

6. The method of claim 4 wherein the step of depositing two amounts of the product into two buckets includes separating in duplex operation the product from a bulk source and dispensing substantially simultaneously the two amounts into the two buckets during a period of pause of the conveying means.

7. A machine for wrapping predetermined amounts of elongated product in packages with sheets of wrapping material, said sheets having both a leading margin and a trailing margin, comprising:

(a) a frame;

(b) endless conveying means carried by the frame and having an upper substantially horizontal run, the conveying means including means forming elongated buckets spaced apart and extending laterally of the direction of conveyor movement;

(c) means for cyclically driving the conveying means with periods of advancing movement separated by periods of pause;

(d) means for superposing sheets of wrapping material over each of the buckets;

(e) means for depositing predetermined amounts of the elongated product upon the sheets whereby the sheets are depressed into the buckets together with the product;

(f) means operating upon the sheets for foding the leading and trailing margins of each sheet over the upper side of the product therein to provide an overlap extending longitudinally over the top of the product, said folding means including a displacable finger for folding the trailing margin of each sheet over the product to define a fold having an axis parallel with the elongated product, drive means connected to the finger for horizontally advancing during said period of advancing movement of the buckets the finger toward the product in each bucket prior to formation of said fold and for horizontally retracting the finger back away from the product in the bucket after the fold is formed, said horizontal advancement and retraction being along a plane parallel with the upper run of the conveying means, and cam means connected to the finger for rotating the finger about an axis parallel to the axis of the fold while forming the fold during said period of advancing movement of the buckets thereby wrapping the trailing margin about the product in the bucket;

(g) a plurality of flexible, non-metallic ribbons operatively connected to the frame of the machine for retaining the margins of the sheets in said overlapping relation as the buckets are advanced, the ribbons overlie and parallel the substantially horizontal run of the conveying means and contact the folded-over margins while the buckets are moving beneath the same; and (h) means for forming a heat seal between the overlapping margins.

8. A method for wrapping predetermined amounts of elongated product in packages with sheets of wrapping material, said sheets having both a leading margin and a trailing margin, comprising the steps of:

(a) conveying a plurality of elongated buckets along a generally horizontal run;

(b) driving cyclically the plurality of buckets with periods of pause between periods of advancing movement;

(c) positioning sheets of wrapping material over the buckets during periods of advancing movement;

(d) depositing predetermined amounts of the product upon the sheets and into the buckets during periods of pause of the conveying means;

(e) folding the leading and trailing margins of each sheet over the upper side of the product to provide an overlap extending longitudinally over the top of the product;

(f) retaining releasable said margins in overlapping relationship using a plurality of flexible ribbons as the bucket is advancing during each period of advancing movement;

(g) heat sealing the longitudinally overlapping margins; and (h) depressing the ribbons about the product immediately before and during the heat sealing step so that the product is compacted into a tight package.

9. The method of claim 8 wherein the step of folding includes folding two sheets in succession over two buckets moving in tandem during each period of advancing movement of the conveying means.

10. A machine for wrapping predetermined amounts of elongated product in packages with sheets of wrapping material, said sheets having both a leading margin and a trailing margin, comprising:

(a) a frame;

(b) endless conveying means carried by the frame and having an upper generally horizontal run, said conveying means including a plurality of elongated buckets extending laterally of the direction of movement of the conveying means, the buckets being spaced apart in the direction of movement, upwardly faced and having means for retaining the leading margins of the sheets relative to the buckets;

(c) means for cyclically driving the conveying means with periods of pause between periods of advancing movement, said buckets move in tandem, one after the other, through the machine;

(d) means for cutting and positioning two sheets of wrapping material in succession over two buckets moving in tandem during each period of advancing movement, said sheets being held by the sheet retaining means;

(e) dispensing means for depositing substantially simultaneously two predetermined amounts of the product upon the sheets and into two of the buckets during each period of pause of the conveying means;

(f) means operating upon the sheets in two of the tandem buckets for folding the leading and trailing margins of the sheets over the upper side of the product deposited therein during each period of advancing motion of the conveying means, said folding occurs in succession to the two sheets;

(g) means operating in duplex upon the sheets in two of the buckets for forming substantially simultaneously a heat seal between the folded leading and trailing margins during each period of pause of the conveying means; and (h) means operating upon the sheets in two of the buckets for foliding the four side margins of the two sheets over the ends of the product and for forming a heat seal between the folded end margins during each period of pause of the conveying means.

11. The machine of claim 10 wherein the sheet cutting and positioning means includes reciprocating drive means for successively advancing two sheet of material over two buckets moving in tandem during each period of advancing movement of the conveying means, said drive means having a crank arm and an operatively connected rack for converting the motion of the conveying means into two reciprocal strokes that are in turn converted using a clutch assembly into a unidirectional shaft output that drives the sheet cutting and positioning means.

12. The machine of claim 10 wherein the heat sealing means for the folded leading and trailing margins includes means for substantially simultaneously heat sealing each of said two margins with a single unitary seal that is commenced and completed during each period of pause of the conveying means.

13. A machine for wrapping predetermined amounts of elongated product in packages with sheets of wrapping material, said sheets having both a leading margin and a trailing margin, comprising:

(a) a frame;

(b) endless conveying means carried by the frame and having an upper substantially horizontal run, the conveying means inclusing means forming elongated buckets spaced apart and extending laterally of the direction of conveyor movement;

(c) means for cyclically driving the conveying means with periods of advancing movements separated by periods pause;

(d) means for superposing sheets of wrapping material over each of the buckets;

(e) means for depositiong predetermined amounts of the elongated product upon the sheets whereby the sheets are depressed into the buckets together with the products;

(f) means operating upon the sheets for folding the leading and trailing margins of each sheet over the upper side of the product therein to provide an overlap extending longitudinally over the top of the product;

(g) a plurality of flexible, non-metallic ribbons operatively connected to the frame of the machine for retaining the margins of the sheets in said overlapping relation as the buckets are advanced, the ribbons overlie and parallel the substantially horizontal run of the conveying means and contact the folded-over margins while the buckets are moving beneath the same;

(h) means for forming a heat seal between the overlapping margins; and (i) means for depressing said ribbons about the product immediately before and during the operation of the heat sealing means so that the product is compacted into a tight package.

14. A machine for wrapping predetermined amounts of elongated product in packages with sheets of wrapping material, comprising:

(a) a frame;

(b) endless conveying means carried by the frame and having an upper substantially horizontal run, the conveying means including a plurality of elongated buckets that are spaced apart in the direction of conveyor movement and extend laterally to the direction of conveyor movement;

(c) means for cyclically driving the conveying means with periods of advancing movment separated by periods of pause, said buckets move one after the other, through the machine;

(d) means for superposing sheets of wrapping material over each of the buckets;

(e) means for depositiong predetermined amounts of the product upon the sheets whereby the sheets are depressed into the buckets together with the product;

(f) means operating upon the sheets for folding the margins of each sheet around the product and for forming a longitudinal heat seal thereon;

(g) finger means operating upon the sheets in the buckets for folding the side margins of the sheets over the ends of the product;

(h) finger drive means adapted for moving the finger means between a first position out of engagement with the sheets and a second position in engagement with the sheets, said drive means including an arm pivotally mounted at one end to the frame and having a free end on which is pivotally mounted the finger means;

(i) finger guide means for pivoting the finger means about the free end of the arm and into inclined lateral engagement with the side margins of the sheets while the finger means is moved by the arm from the first position to the second position, said finger guide means including a rod pivotally mounted at one end to the finger means and rod guide means slidably receiving said rod and pivotably connected to the frame for translatably and pivotally mounting the rod to the frame so that said rod is both pivotable and radially translatable between predetermined limits with respect to the rod guide means; and (j) means for forming a heat seal between the folded side margins.

15. The machine of claim 14 wherein the side margin folding means includes second finger means for folding the top of the side margin over the end of the product, second finger drive means for vertically translating the second finger means between a first position out of engagement with the top of the side margin and a second position in engagement with the tp of the side margin of the sheets, and second finger guide means for pivoting the second finger means into inclined engagment with the top of the side margins while the second finger means is movef from the first position to the second position in a flat plane perpendicular to the run of the conveying means so that the top of the side margin of each sheet is folded by an arcuate motion of the second finger means, said arcuate motion occurring in a flat plane that is perpendicular to the run of the conveying means.

16. A machine for wrapping predetermined amounts of elongated product in packages with sheets of wrapping material, comprising:

(a) a frame;

(b) endless coveying means carried by the frame and having an upper substantially horizontal run, the conveying means including a plurality of elongated buckets that are spaced apart in the direction of conveyor movement and extend laterally to the direction of conveyor movement;

(c) means for cyclically driving the conveying means with periods of advancing movement separated by periods of pause, said buckets move one after the other, through the machine;

(d) means for superposing sheets of wrapping material over each of the buckets;

(e) means for depositiong predetermined amounts of the product upon the sheets whereby the sheets are depressed into the buckets together with the product;

(f) means operating upon the sheets for folding the margins of each sheet around the product and for forming a longitudinal heat seal thereon;

(g) finger means operating upon the sheets in the buckets for folding the side margins of the sheets over the ends of the product;

(h) finger drive means adapted for moving the finger means between a first position out of engagement with the sheets and a second position in engagement with the sheets, said drive means including a guide rod mounted laterally and parallel with the conveying means, a carriage slidably and rotatably received on the rod for both translational and rotational motion thereabout, an arm mounted on the carriage and having a free end on which is pivotally mounted the finger means, said guide rod, carriage and arm permitting translational motion of the finger means along a path parallel to the run of the conveying means and arcuate elevational motion of the finger means above the path of the buckets by rotation about the guide rod;

(i) finger guide means for pivoting the finger means about the free end of the arm and into inclined lateral engagement with the side margins of the sheets while the finger means is moved by the arm from the first position to the second position; and (j) means for forming a heat seal between the foled side margins.

17. The machine of claim 16 wherein the side marging folding means includes second finger means for folding the top of the side margin over the end of the product, second finger drive means for vertically translating the second finger means between a first position out of engagement with the top of the side margin and a second position in engagement with the top of the side margin of the sheets, and second finger guide means for pivoting the second finger means into inclined engagement with the top of the side margins while the second finger means is moved from the first position to the second position in a flat plane perpendicular to the run of the conveying means so that the top of the side margin of each sheet is folded by an arcuate motion of the second finger means, said arcuate motion occurring in a flat plane that is perpendicular to the run of the conveying means.

18. A method for wrapping predetermined amounts of elongated product in packages with sheets of wrapping material, comprising the steps of:

(a) conveying a pluraity of elongated buckets along a generally horizontal run;

(b) driving cyclically the pluraity of buckets with periods of pause between periods of advancing movement;

(c) positioning sheets of wrapping material over the buckets during periods of advancing movement;

(d) depositing predetermined amounts of the product upon the sheets and into the buckets during periods of pause of the conveying means;

(e) folding the margins of the sheets around the product to provide a longitudinal overlap;

(f) heat sealing the longitudinal overlapping margins;

(g) depressing finger means vertically downward along an arcuate path from an elevated position above the sheets and the product;

(h) translating the finger means along a horizontal path parallel to the run of the conveying means and toward the sheets and product substantially simultaneously with the last named step;

(i) pivoting the finger means into inclined lateral engagement with the side margins of the sheets substantially simultaneously with the last two mentioned steps;

(j) folding the side margins of the sheets over the ends of the product with the finger means during each period of pause of the conveying means; and heat sealing the folded side margins of the sheets to form packages during each period of pause of the conveying means.

* * * * *